US008474290B2

(12) United States Patent
Terhaar et al.

(10) Patent No.: US 8,474,290 B2
(45) Date of Patent: Jul. 2, 2013

(54) LOCKING HANDLE AND POWER MODULE ASSEMBLY

(75) Inventors: David Lee Terhaar, Allegan, MI (US); David Jay Terhaar, Holland, MI (US)

(73) Assignee: PiOptima, Inc., Zeeland, MI (US)

( * ) Notice: Subject to any disclaimer, the term of this patent is extended or adjusted under 35 U.S.C. 154(b) by 412 days.

(21) Appl. No.: 12/592,827

(22) Filed: Dec. 3, 2009

(65) Prior Publication Data

US 2011/0132047 A1 Jun. 9, 2011

(51) Int. Cl.
*E05B 47/06* (2006.01)

(52) U.S. Cl.
USPC ..... 70/92; 70/210; 70/215; 70/224; 70/278.7; 70/279.1; 70/283; 70/423; 70/452; 70/455; 70/465; 292/21; 292/92; 292/356; 292/DIG. 29; 292/DIG. 43

(58) Field of Classification Search
USPC ..... 70/92, DIG. 42, 210, 215, 216, 224, 70/478, 465, 455, 423, 427, 208, 277, 278.7, 70/279.1, 278.3, 283, 283.1, 452; 292/21, 292/92, DIG. 65, DIG. 31, 336.6, DIG. 29, 292/DIG. 5, DIG. 11, DIG. 14, DIG. 42, 292/DIG. 43, DIG. 62, 356
See application file for complete search history.

(56) References Cited

U.S. PATENT DOCUMENTS 902,044 A * 10/1908 Augenbraun ..... 70/451
1,461,756 A * 7/1923 Croning ..... 70/452
1,495,820 A * 5/1924 Tierney ..... 70/108
1,654,149 A * 12/1927 Teich ..... 70/216
2,213,814 A * 9/1940 Jacobi ..... 70/455
2,343,605 A * 3/1944 Wise ..... 70/455
2,355,300 A * 8/1944 Johnstone ..... 70/455
2,427,909 A * 9/1947 Howell ..... 70/216
2,439,978 A * 4/1948 Konchan ..... 70/455
3,285,043 A * 11/1966 Dauenbaugh et al. ..... 70/208
3,302,434 A * 2/1967 Dauenhaugh et al. ..... 70/208
3,503,233 A * 3/1970 Armstrong et al. ..... 70/370
4,080,812 A * 3/1978 Knott ..... 70/256
4,155,233 A * 5/1979 Lira ..... 70/92
4,167,104 A * 9/1979 Bond ..... 70/208
4,316,371 A * 2/1982 Del Nero ..... 70/417
4,586,354 A * 5/1986 Smith ..... 70/451
4,936,122 A * 6/1990 Osada ..... 70/214
5,251,467 A * 10/1993 Anderson ..... 70/370
5,548,981 A * 8/1996 Kirk ..... 70/58
6,354,050 B1 3/2002 Pankoski
7,363,786 B2 * 4/2008 TerHaar et al. ..... 70/208
7,401,484 B1 * 7/2008 Holmes et al. ..... 70/423
2003/0200776 A1 * 10/2003 Stillwagon ..... 70/208
2006/0028031 A1 * 2/2006 Tibbenham et al. ..... 292/336.3
2006/0248931 A1 * 11/2006 Boulard et al. ..... 70/208
2008/0072636 A1 * 3/2008 Padilla et al. ..... 70/278.7

* cited by examiner

*Primary Examiner* — LLoyd Gall
(74) *Attorney, Agent, or Firm* — Clark Hill PLC

(57) ABSTRACT

An improved locking handle and power module assembly provides continued ability to open and close a truck cap or tonneau cover from within or without, and presents an enclosed mechanism to prevent obstruction or jamming. A release handle is provided to permit unlatching of a latch mechanism operated by the locking handle without regard to whether the locking handle is locked or not.

22 Claims, 32 Drawing Sheets

LOCKING HANDLE AND POWER MODULE ASSEMBLY

FIELD OF THE INVENTION

The invention relates to locking mechanisms for truck bed closures, or more specifically to manual and/or electrically actuated locking mechanisms for truck bed caps or tonneau covers.

BACKGROUND OF THE INVENTION

Trucks, e.g. conventional pickup trucks, typically have a cargo bed bounded by a bottom wall and one or more sidewalls and an open portion or bed opening through which cargo is received. It is common to protect such cargo against weather, theft, etc., to selectively close such bed opening with an openable closure, such as a cap or tonneau cover which is supported on the bed walls and overlies the bed opening. Such truck caps and tonneau covers are known to have a locking mechanism that, unlike conventional passenger vehicle doors, are typically simple mechanical devices securing the cover or lift gate by using a pivoting handle actuating a rod or cable to release a latch. The pivoting handle typically has an internal lock tumbler that allows the handle to pivot when placed in the appropriate orientation.

An improvement to this arrangement was presented in U.S. Pat. No. 6,354,650, having common inventorship with the instant disclosure, wherein an electric actuator was arranged at the latch, whereby the latch anchor points were displaced from the latch in order to release the latch without the need to pivot the handle. The pivoting handle would remain locked, necessitating continued access to the remote actuator, or access to the key in order to open the cover multiple times.

A further improvement to this arrangement was presented in U.S. Pat. No. 7,363,786, commonly owned, wherein a locking assembly for a truck bed closure was provided, including an internal frame mounting a slider with a dog-receiving aperture, wherein the slider is shiftable between locked and unlocked positions by rotation of a dog within the aperture, or by the action of an electric actuator upon the slider. Upon release of the slider, a shaft-mounted disk could be rotated, drawing upon latch release cables. The components of this arrangement were somewhat bulky, however, and could be exposed to interference or jamming by debris in the truck bed.

The invention relates to an improved locking handle and power module assembly that provides continued ability to open and close a truck cap or tonneau cover from within or without, and presents an enclosed mechanism to prevent obstruction or jamming.

Other objects and purposes of the invention, and variations thereof, will be apparent upon reading the following specification and inspecting the accompanying drawings.

Figure 1:
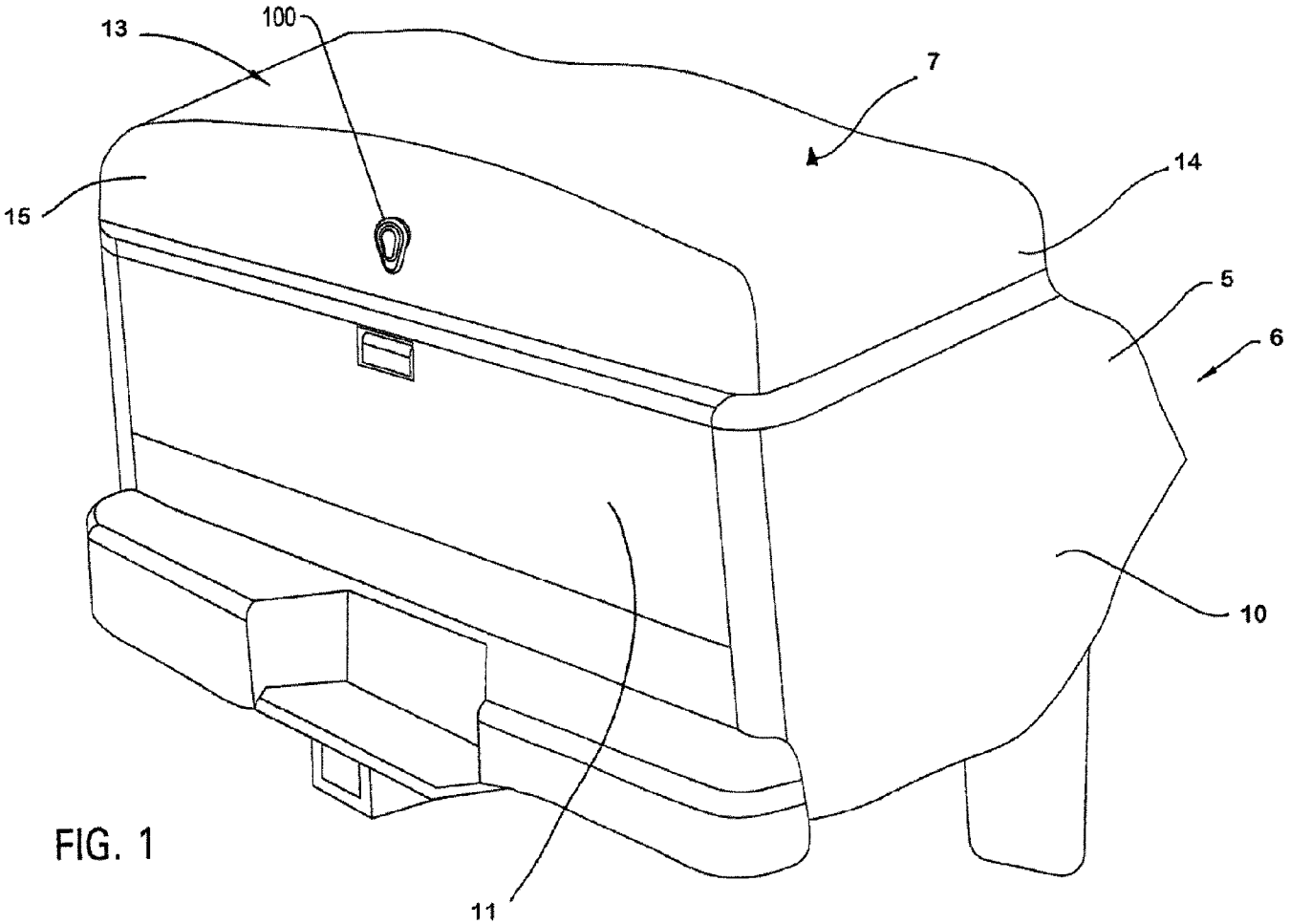
FIG. 1 is a perspective view of a pick up truck with a tonneau cover provided with a locking handle assembly according to the invention.

Certain terminology will be used in the following description for convenience and reference only, and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the arrangement, and designated parts thereof. Said terminology will include the words specifically mentioned, derivatives thereof, and words of similar import.

DETAILED DESCRIPTION

FIG. 1 depicts a bed portion 5 of a pickup truck 6. The bed portion 5 comprises upstanding side walls 10 which typically extend around three sides of the interior storage area of the bed portion 5 which also includes an openable tailgate 11. The side walls 10 and gate 11 define a bed opening or open portion which provides downward access into the storage area of the bed portion 5. The bed portion 5 is covered by a tonneau cover 7 which is supported on the side walls 10 and is lockable to the structure of the bed portion 5. On an end closure panel or wall 15 of the tonneau cover 7, a locking handle and power module assembly 100 is provided according to the invention for locking the tonneau cover 7 in the closed position shown. The tonneau cover 7 includes a horizontally enlarged top wall 13 and side walls 14 as well as an end wall 15 which mounts the locking handle and power module assembly 100 thereon.

Figure 1A:
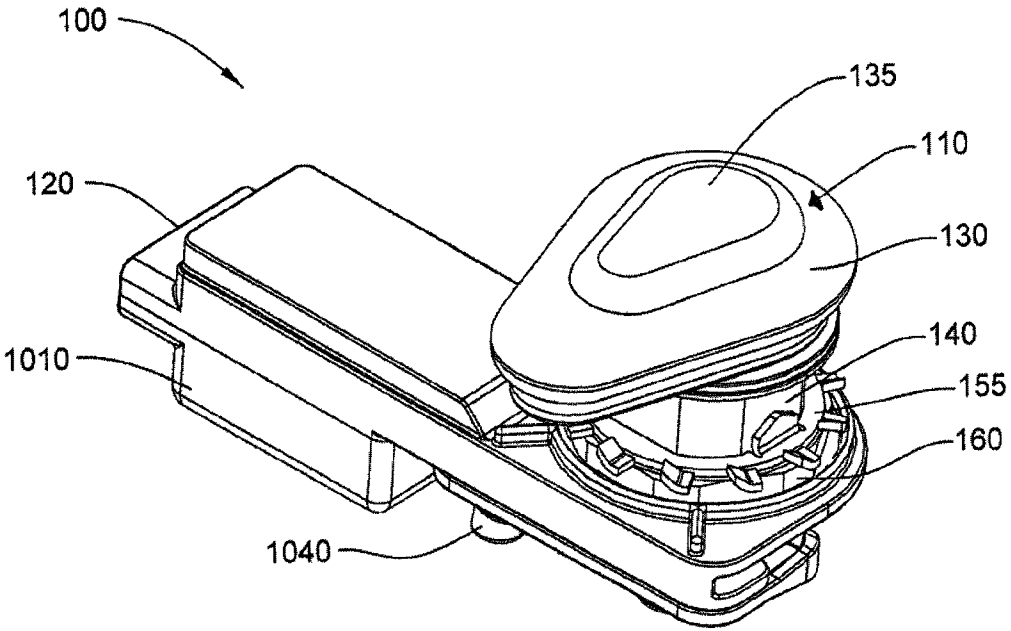
FIG. 1A is a perspective view of a locking handle and power module assembly according to the invention.

The locking handle and power module assembly 100 according to the invention, as shown in FIG. 1A, includes a locking handle assembly 110 for manual opening or latching/unlatching and a power module 120 for electrically locking and unlocking the assembly 100, wherein the assembly 100 is operable in any combination of manual or electrical locking or unlocking. As such, the locking handle and power module assembly 100 can be tied directly to a vehicle door lock system so as to be unlocked and locked electrically in unison therewith or may also be manually operated independent of the vehicle door lock system so as to permit manual opening of the tonneau cover 7 even if the vehicle door lock system is in the locked condition. Thus, the assembly 100 can be operated with or without electrical power. Even if power is maintained, manual operation of the locking handle and power module assembly 100 is still permitted so as to be operable manually or electrically, which electrical operation can be performed by any electrical switching system such as the aforementioned vehicle door lock system.

Figure 2:
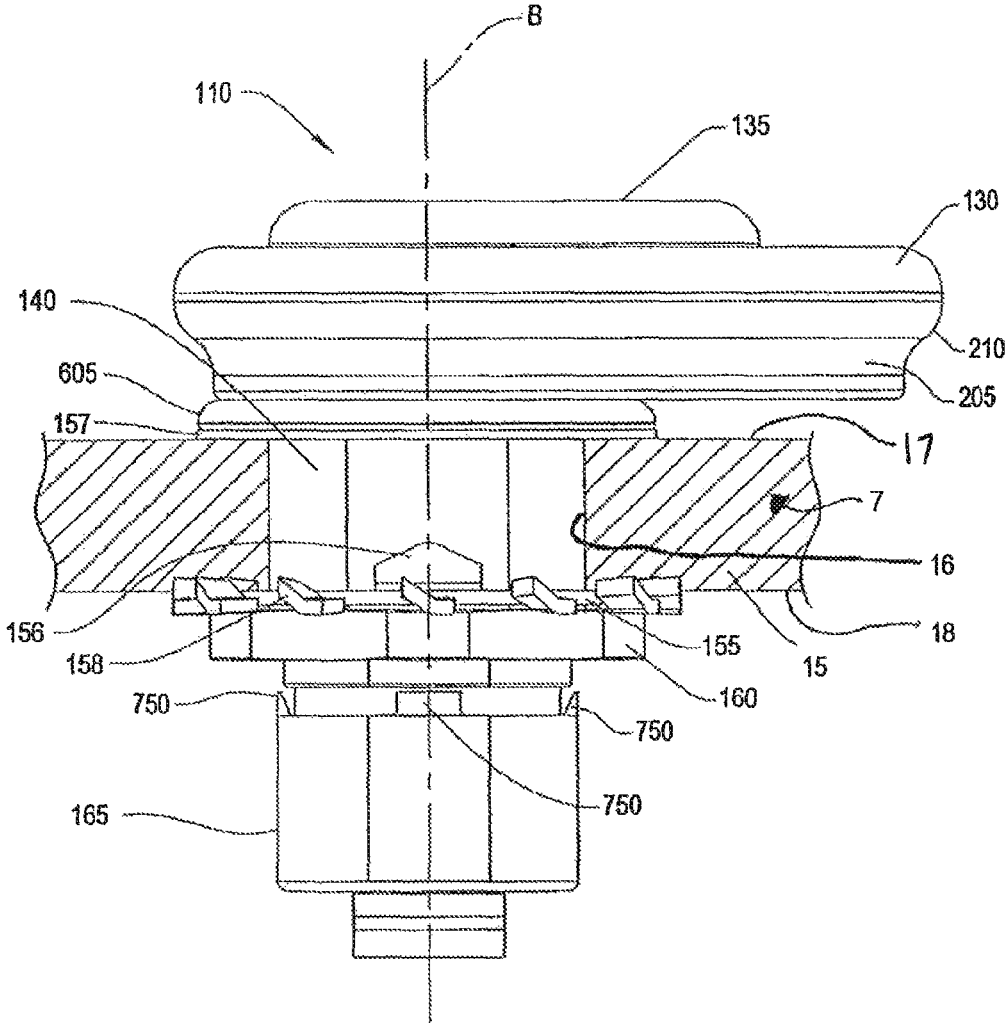
FIG. 2 is a side view of the locking handle portion of the assembly of FIGS. 1 and 1A.
Figure 3:
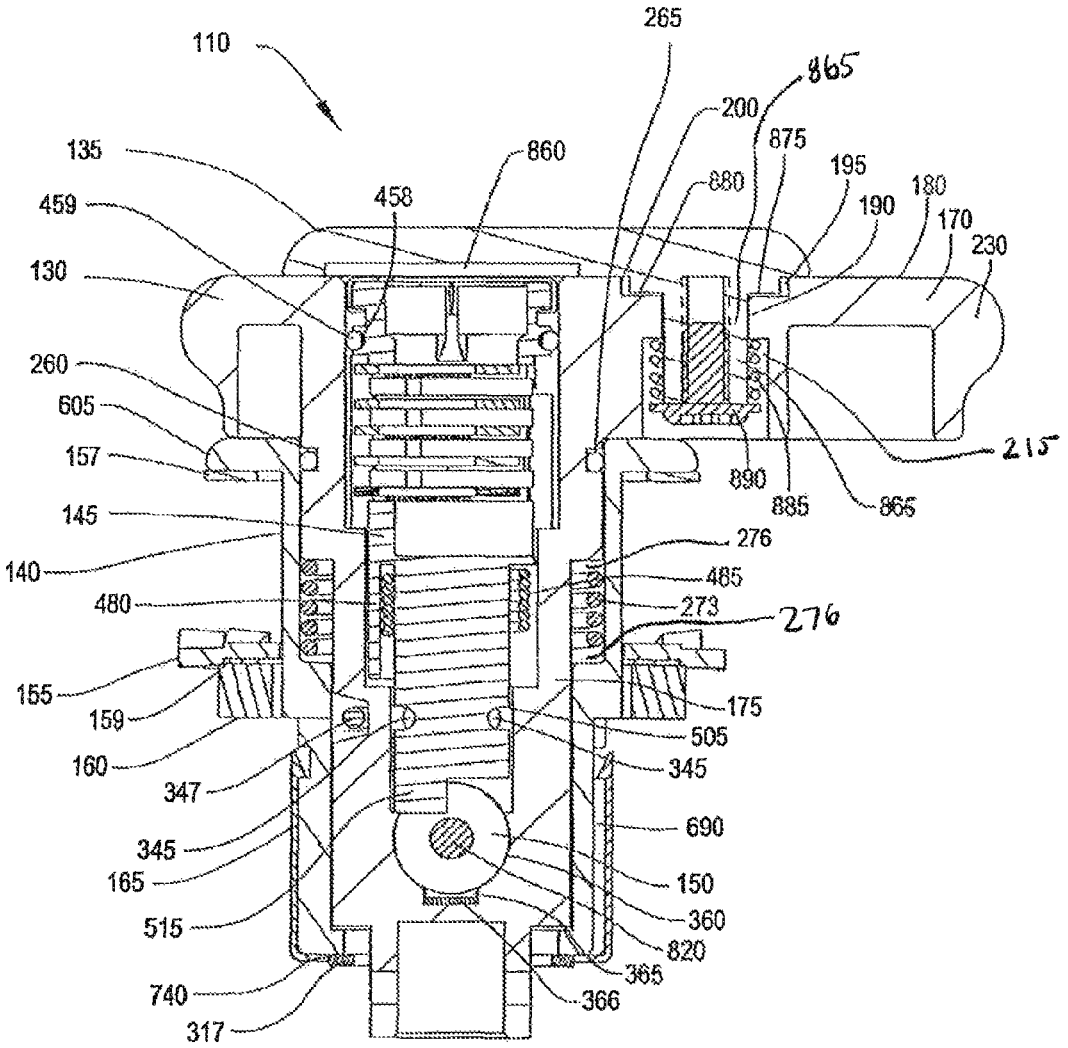
FIG. 3 is a cross sectional view of the locking handle portion of FIG. 2.
Figure 13:
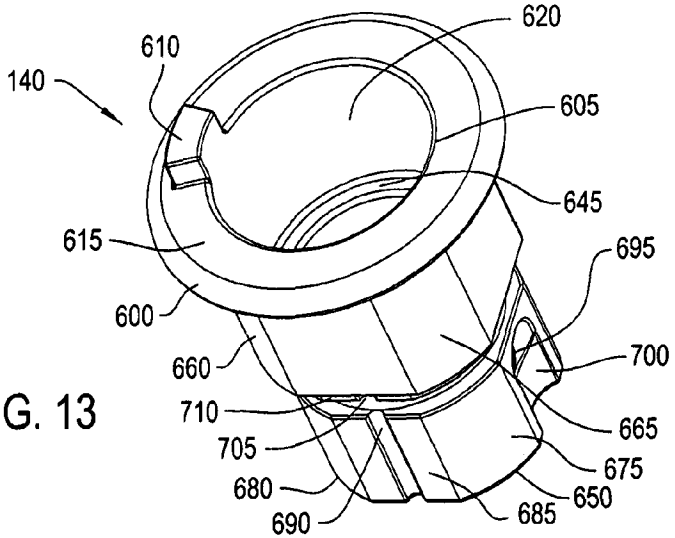
FIG. 13 is a perspective view of a bushing of the locking handle assembly of FIGS. 2 and 3.
Figure 14:
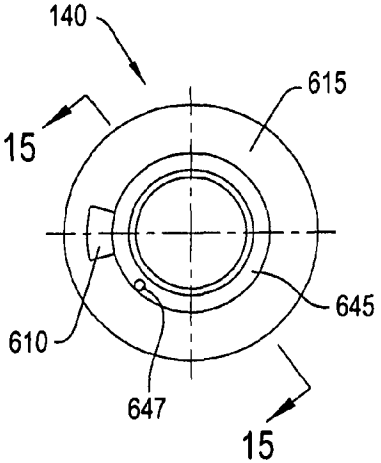
FIG. 14 is a plan view of the bushing of FIG. 13.

The locking handle assembly 110, as shown in FIGS. 2 and 3 without the power module 120, includes an externally-accessible handle 130, cover 135, bushing 140 passing through the end closure panel 15, key cylinder assembly 145 which is lockable, slide bolt 150, anti-rotation washer 155, sealing gasket 157, bushing connector or nut 160 and dust cover cap 165. The locking handle assembly 110 is non-rotationally secured to the end wall 15 by the washer 155 and nut 160. The bushing 140 passes through an aperture 16 (FIG. 2) in the closure panel 15, and includes an outwardly arranged flange 605 at its proximal end 600 (FIG. 13) that traps the sealing gasket 157 against the uter face 17 of the tonneau cover 7, The bushing 140 is secured in the closure panel 15 by bushing nut 160, with anti-rotation washer 155 interposed between nut 160 and an inner face 18 of the cover 7. The dust cover cap 165 covers a lower portion of the bushing 140 that receives the power module 120 when installed. A detailed description of the individual elements follows, and FIG. 3 is described in more detail below under "Assembly". In this manner, the locking handle and power module assembly 100 is mountable to the tonneau cover wall 15 wherein the handle 130 is rotatable about the rotation axis B of FIG. 2 to allow manual unlatching of the locking handle assembly 110.

Figure 4:
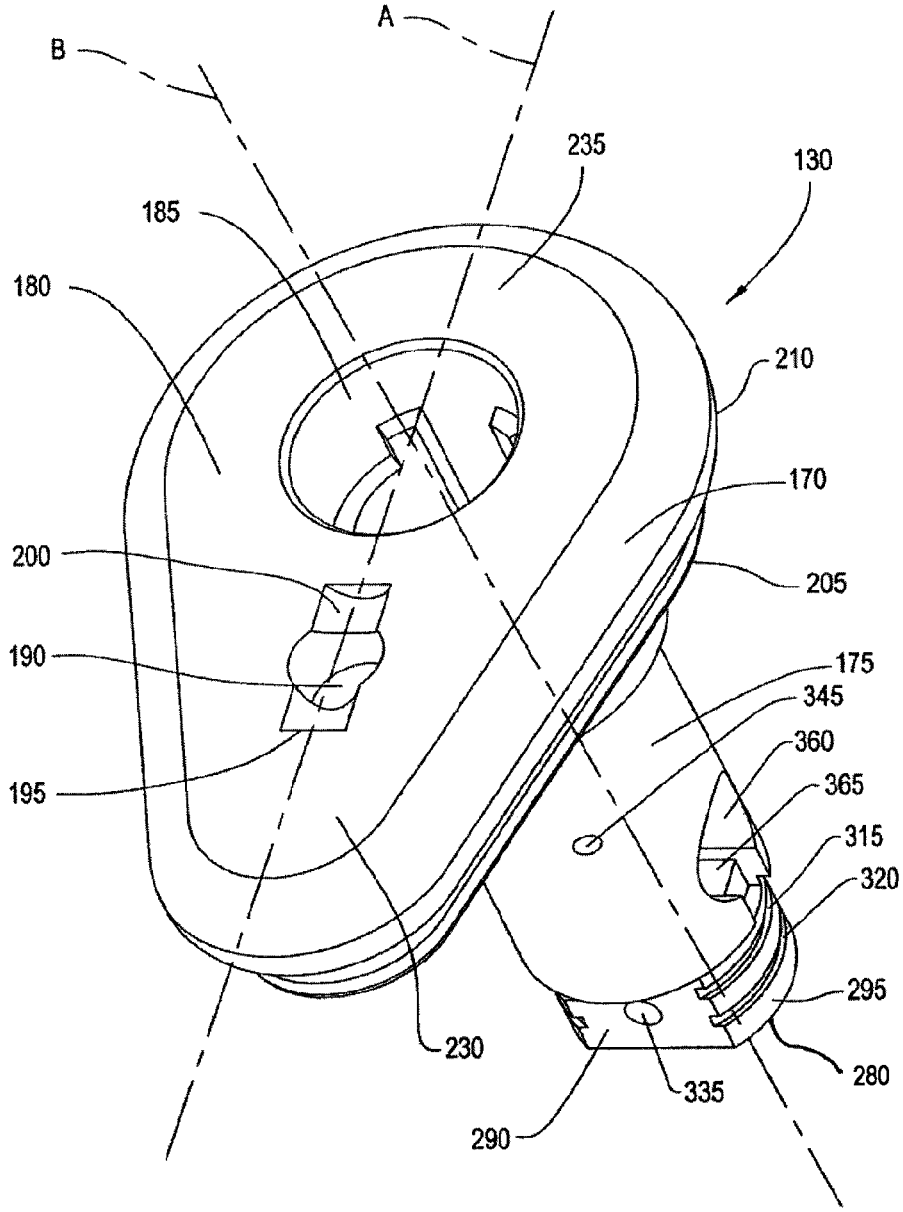
FIG. 4 is a perspective view of a handle element of the locking handle of FIGS. 2 and 3.
Figure 5:
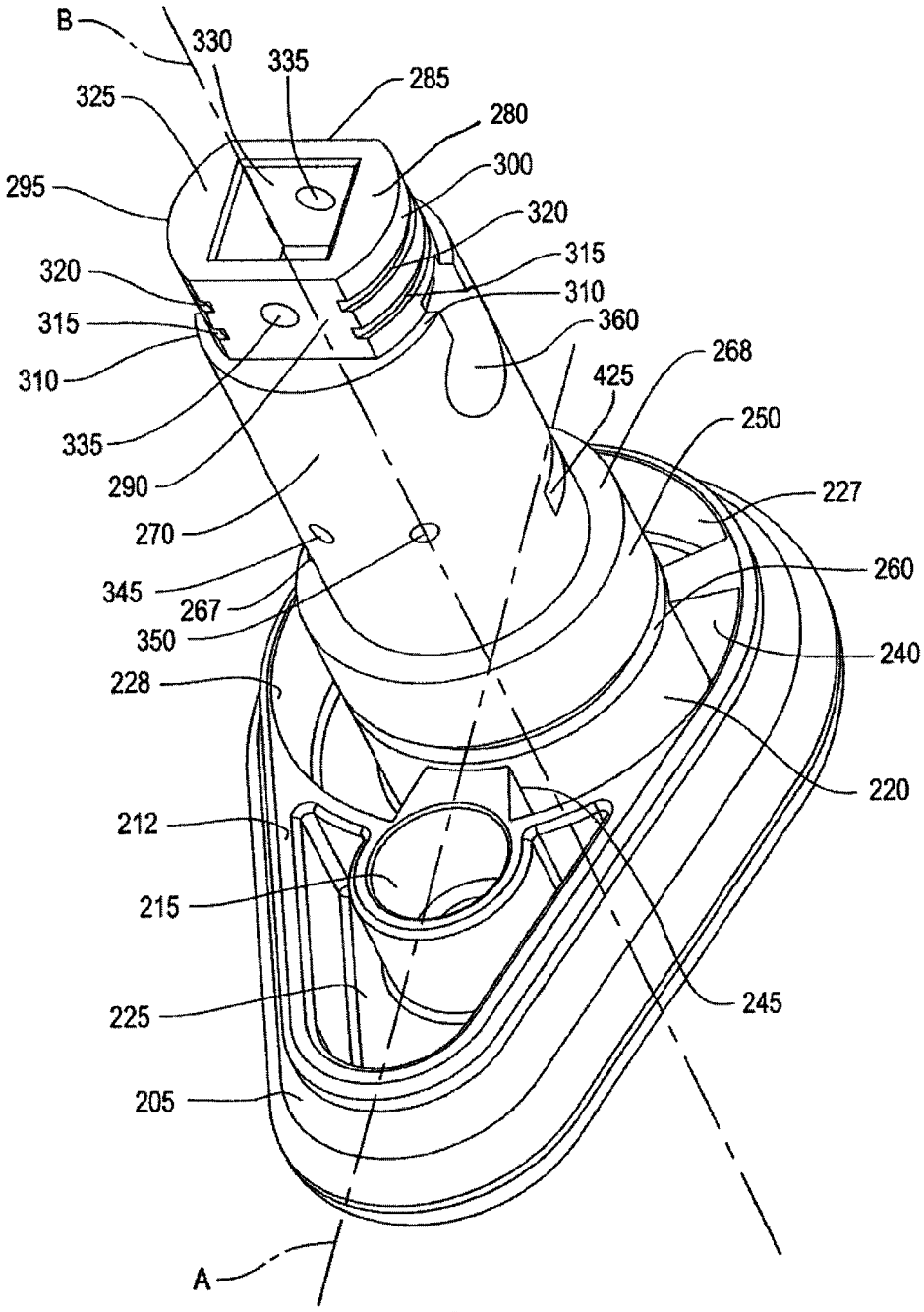
FIG. 5 is a bottom perspective view of the handle element of FIG. 4.
Figure 6:
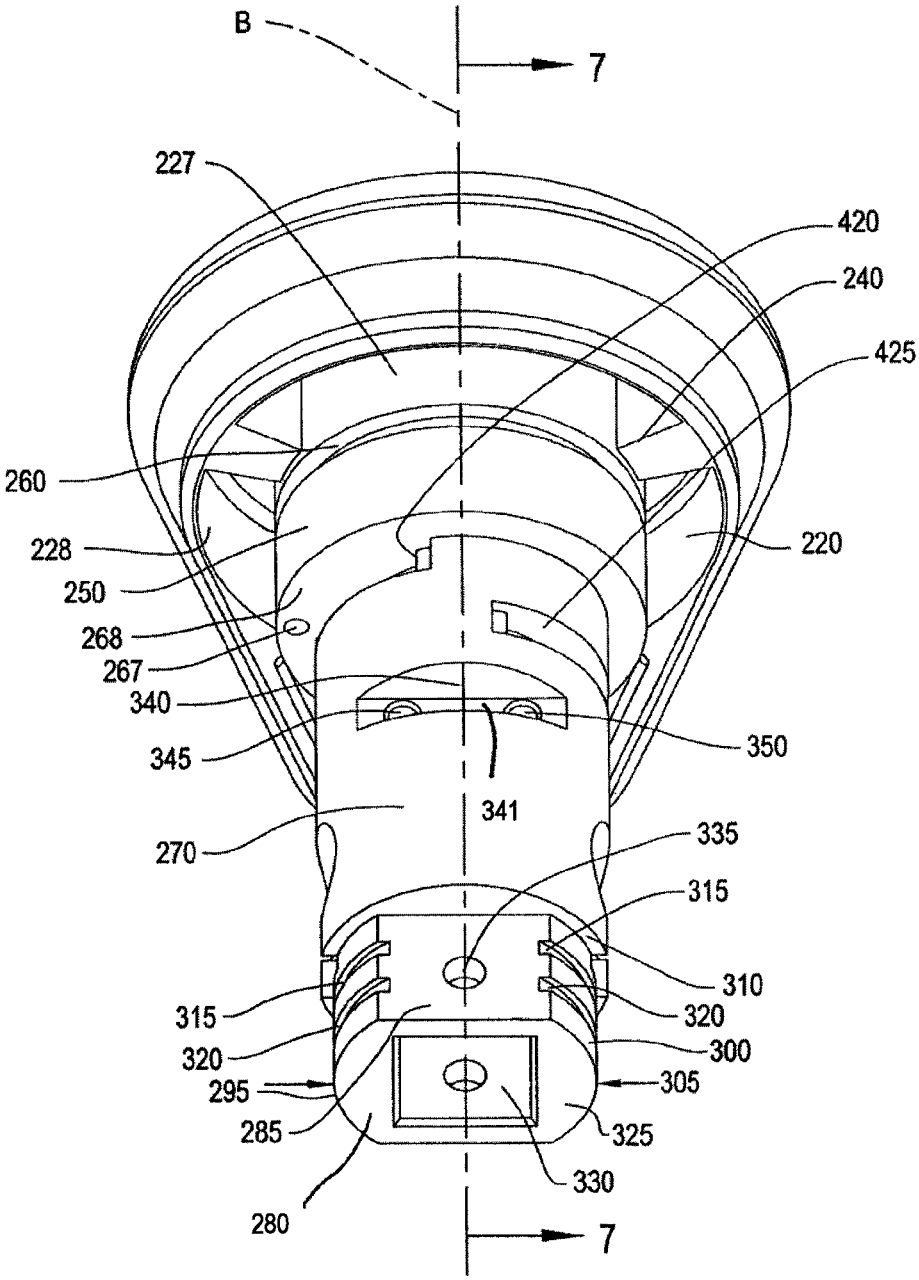
FIG. 6 is a reverse perspective view of the handle element of FIGS. 4 and 5.

Referring to FIGS. 4-6, the handle 130 includes a gripping or interface portion 170, which is exposed outside of the tonneau cover 7 so as to be manually rotatable, and a shaft portion 175 extending distally from the gripping portion 170, which is rotatably supported in the bushing 140 and defines the otation axis B about which the handle 130 rotates. The gripping portion 170 has a flat external face 180 preferably having a tear-drop shape or other suitable shape. Differently-sized first and second apertures or bores 185, 190 (FIG. 4) are open in the external face 180 of the gripping portion 170. The relatively large first aperture 185 is centered in the wider end 235 of the external face 180, and is aligned and centered with the shaft portion 175 of the handle 130 with axis B extending the ethrough and defines an outer bore end opening. The aperture 185 is configured for receiving the key cylinder assembly 145 through the outer bore end opening, as will be further discussed below, and is covered by the cover 135 to seal the cylinder assembly 145 after locking.

The smaller second aperture 190 is provided to rotatably support the cover 135 over the cylinder assembly 145, is cylindrical and centered on the narrow end 230 of the external face 180 to one side of the first aperture 185, and passes through the gripping portion 170 of the handle 130. A pair of concave pockets 195, 200 are formed diametrically opposite from one another adjacent to the cylindrical aperture 190 and in line with a longitudinal axis A of the gripping portion 170. The pockets 195, 200 serve as a detent for defining the rotation of the cover 135, which is mounted to the handle 130 through the aperture 190 (FIG. 3).

To facilitate gripping and handle rotation, the gripping portion 170 of the handle is contoured around its perimeter and has a reduced portion 205 in the distal direction, thereby forming a rounded overhang 210 proximate the external handle face 180. Opposite the external face 180, an inner handle face 212 of the gripping portion 170 is formed with cavities 215, 220 (FIGS. 5 and 6).

The first cavity 215 is formed about and beneath the cylindrical aperture 190 passing through the face 180 of the gripping portion 170, for receiving a spring 885 and fastener 890 for securing the cover 135 (FIG. 3) to the handle 130.

The second cavity 220 surrounds the shaft portion 175 and extends approximately one quarter of the way around the circumference of the shaft portion 175 and terminates at right and left ends 240, 245 which interact with the bushing 140 to restrict rotation of the handle 130 as will be described further herein.

Additional cavities 225, 227, 228 are formed during molding adjacent the narrow end 230 of the gripping portion 170 and follow the contour of the wide end 235 of the gripping portion 170 around the shaft portion 175, respectively. These cavities 225, 227, 228 are provided for weight and material savings.

Figure 7:
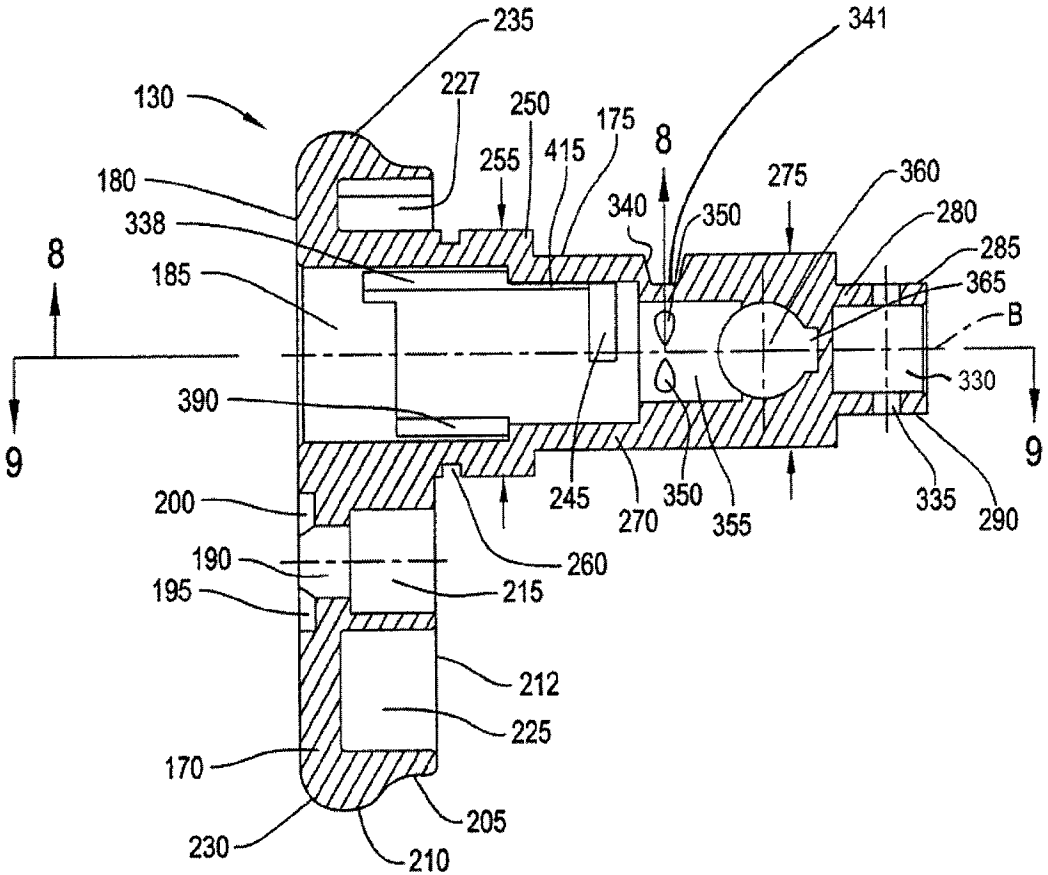
FIG. 7 is a cross-sectional view of the handle element taken through line 7-7 of FIG. 6.

To rotatably support the handle 130, the shaft portion 175 of the handle 130 is generally cylindrical, and defines the central axis of rotation B about which the handle 130 is rotatable when seated in the bushing 140. As the shaft portion 175 extends lengthwise distally away from the gripping portion 170, the internal and external contours of the shaft portion 175 vary. First, adjacent to the gripping portion 170, the shaft portion 175 includes a proximal portion 250 having a wide first diameter 255 (FIG. 7). An annular sealing groove 260 having a second, reduced diameter is formed in the proximal portion 250, separated minimally from the inner face 212 of the gripping portion 170. The annular groove 260 receives an O-ring 265 (FIG. 3) which is disposed in tight-fitting sealing contact with the bushing 140 to prevent environmental moisture and precipitation from leaking into the handle assembly 110. A handle return spring pocket 267 (FIG. 6) is formed in a distal shoulder 268 of the proximal portion 250, for receiving a leg 272 of a handle return spring 273 (FIGS. 3 and 34) which permits handle rotation but biases the handle 130 back to the initial position.

Axially adjacent to the proximal portion 250, a central shaft portion 270 has a reduced diameter 275 (FIG. 7). The reduced diameter 275 of the central shaft portion 270 is spaced radially inwardly of the bushing 140 as seen in FIG. 3 to define a clearance space 276 which accommodates the handle return spring 273 therein.

Referring to FIGS. 4-6, a tip portion 280 of the shaft portion 175 is formed as a truncated cylinder having oppositely situated flat sides 285, 290 arranged perpendicularly to the longitudinal axis A of the gripping portion 170. Convex sides 295, 300 define a further reduced diameter 305, forming an axially-facing shoulder 310 at the distal end of the central shaft portion 270 (FIGS. 5 and 6). A pair of aligned arcuate grooves 315, 320 are formed parallel to each other in the convex sides 295, 300, and are axially spaced from each other in the distal or axial direction. The grooves 315, 320 are configured for receiving a snap ring 317 (FIG. 3) which is installed after the handle 130 is inserted in the bushing 140 and thereby, secures the handle 130 to the bushing 140 by preventing axial removal therefrom.

In this embodiment, the distal end 325 of the shaft 175 faces axially and is formed with a pocket 330 within the tip portion 280 which has a square profile that opens axially from the end face of the tip portion 280. An aperture or bore 335 passes sidewardly through each of the flat faces 285, 290 of the tip portion 280, in sideward alignment with each other, into the square pocket 330.

Figure 36:
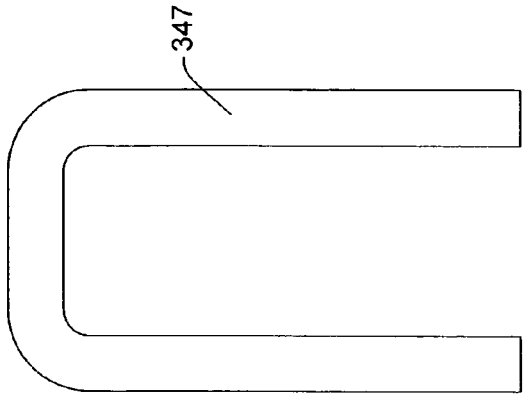
FIG. 36 is a front view of a U-clip of FIGS. 29-32.

Referring again to the central shaft portion 270, a transverse notch 340 is provided in an outer face thereof, wherein a bottom notch face 341 is parallel to flat face 285 (FIGS. 6 and 7). Within the concavity formed by the notch 340, a pair of apertures 345, 350 are formed for receiving the legs of a U-clip 347 (FIG. 36) for securing the key cylinder assembly 145 within the handle 130 as will be described herein. The apertures 345, 350 pass through an interior cylindrical cavity 355 in a distal portion of the central shaft portion 270, wherein each aperture 345, 350 is positioned at the outer edges thereof (FIG. 7), and exits through the opposite side of the central shaft portion 270 (FIG. 5). The interior cavity 355 receives the cylinder assembly 145 therein.

Figure 9:
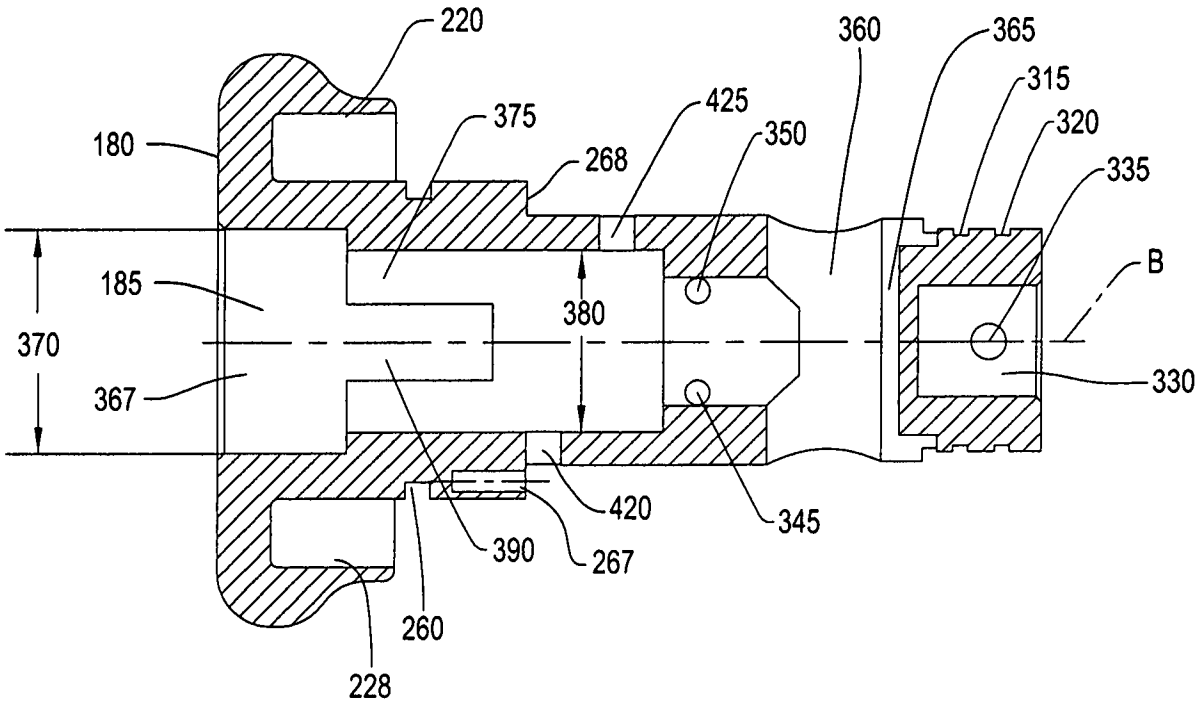
FIG. 9 is a cross-sectional view of the handle element taken through line 9-9 of FIG. 7.
Figure 35:
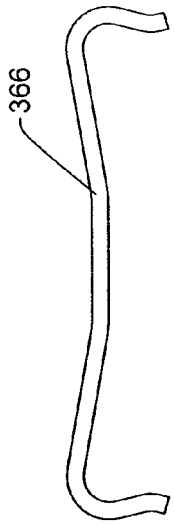
FIG. 35 is a front view of a slide bolt detent spring of FIGS. 29-32.

To accommodate the slide bolt 150 (FIGS. 3 and 29) which selectively locks out rotation of the handle 130 relative to the bushing 140, a transverse passage 360 or bore is formed in the distal portion of the central shaft portion 270 as shown in more detail in FIGS. 7 and 9. The passage 360 has opposite open ends which open sidewardly. The transverse passage 360 is generally circular in cross section, and includes a radial keyhole portion 365 extending distally and radially from the passage 360 toward the tip 280 of the shaft 175, for receiving a slide bolt detent spring 366 (FIGS. 3, 31 and 35) which resists movement of the slide bolt 150 by frictional contact therewith.

Figure 8:
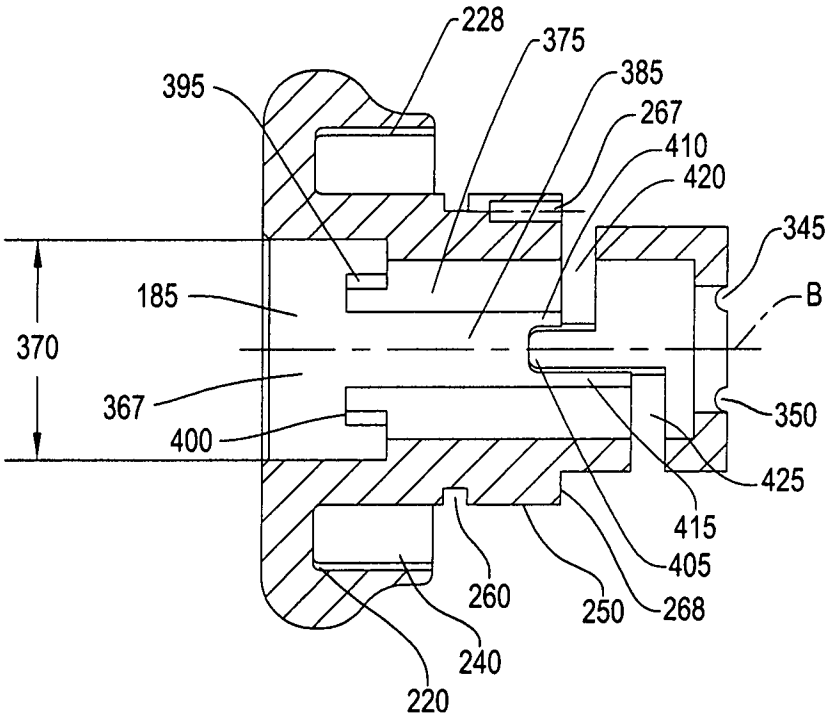
FIG. 8 is a cross-sectional view of the handle element taken through line 8-8 of FIG. 7.

More particularly as to the key cylinder assembly 145, the central aperture 185 of the shaft portion 175 is configured to receive the key cylinder assembly 145 axially therein through the top of the handle 130. Referring to FIGS. 8 and 9, the central aperture 185 has at its proximal end a cup portion 367 having a primary diameter 370 that defines the mouth or open end of aperture 185. Distal of the cup portion 367 lies a tumbler portion 375 having a reduced diameter 380. The tumbler portion 375 includes a pair of opposing tumbler cavities 385, 390 on diametrically opposite sides of the tumbler portion 375. The tumbler cavities 385, 390 define an increased diameter equal to diameter 370 so that cavities 385, 390 open axially into cup portion 367. A pair of rotation stops 395, 400 extend axially or proximally from the tumbler portion 375 and project radially inwardly into the cup portion 367 to limit rotation of key cylinder 145 by blocking rotation stops 462, 463 of the key cylinder 145 (FIGS. 10-12) which project radially outwardly and are disposed circumferentially between the stops 395, 400. At the distal end of the tumbler cavity 385, a central pillar 405 is provided. On either side of the central pillar 405, a key cylinder return spring channel 410, 415 extends to a respective key cylinder return spring pocket 420, 425.

Figure 10:
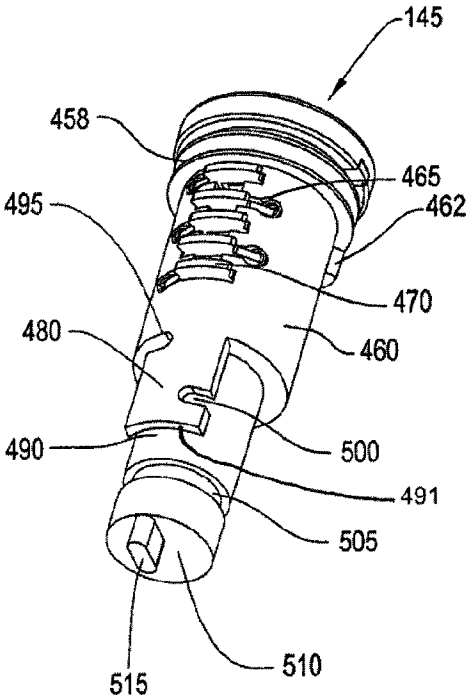
FIG. 10 is a perspective view of a key cylinder assembly of the locking handle of FIGS. 2-9.
Figure 11:
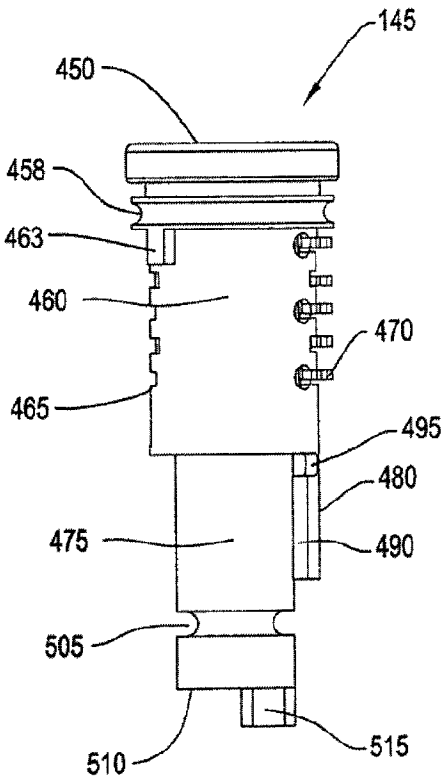
FIG. 11 is a side view of the key cylinder assembly of FIG. 10.
Figure 12:
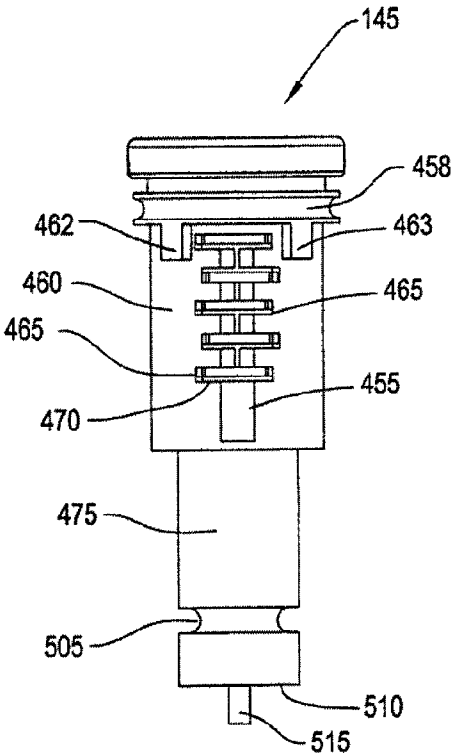
FIG. 12 is a back view of the key cylinder assembly of FIGS. 10-11.
Figure 16:
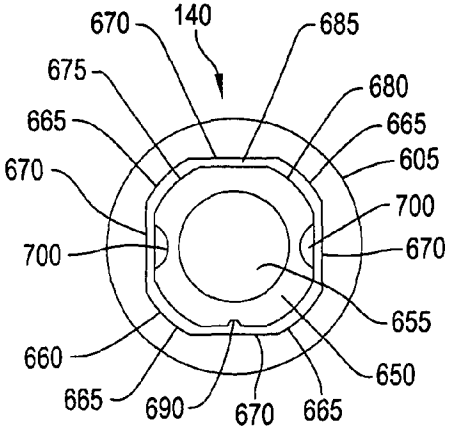
FIG. 16 is a bottom view of the bushing of FIGS. 13-15.
Figure 15:
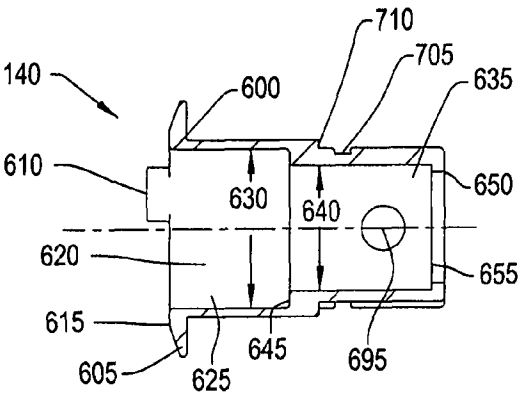
FIG. 15 is a cross-sectional view of the bushing taken through line 15-15 of FIG. 14.

Referring now to FIGS. 10-12, the key cylinder assembly 145 is generally cylindrical, and includes a circular external face 450 having a rectangular slot 455 for receiving a key K (FIGS. 31 and 32) configured to match the arrangement of the key cylinder 145, as is well known in the art. The slot 455 extends internally within the key cylinder assembly 145. The slot 455 includes a number of inwardly projecting rails (not shown) that are configured to engage and align a key having matching grooves, for positioning the key laterally and transversely within the cylinder, relative to tumblers 470 carried by a tumbler portion 460 of the key cylinder assembly 145, as is well known in the art. An O-ring channel 458 is arranged distally of the external face 450 for receiving O-ring 459 (FIG. 3) to seal the cylinder assembly 145. A pair of aforementioned rotation stops 462, 463 extend radially outwardly from the tumbler portion 460, distally of the O-ring groove 458. The tumbler portion 460 of the key cylinder assembly 145 includes a plurality of transverse slots 465 passing through the tumbler portion 460 generally centered on the longitudinal slot 455 receiving the key. Each of the transverse slots 465 receives one of the tumblers 470.

Figure 29:
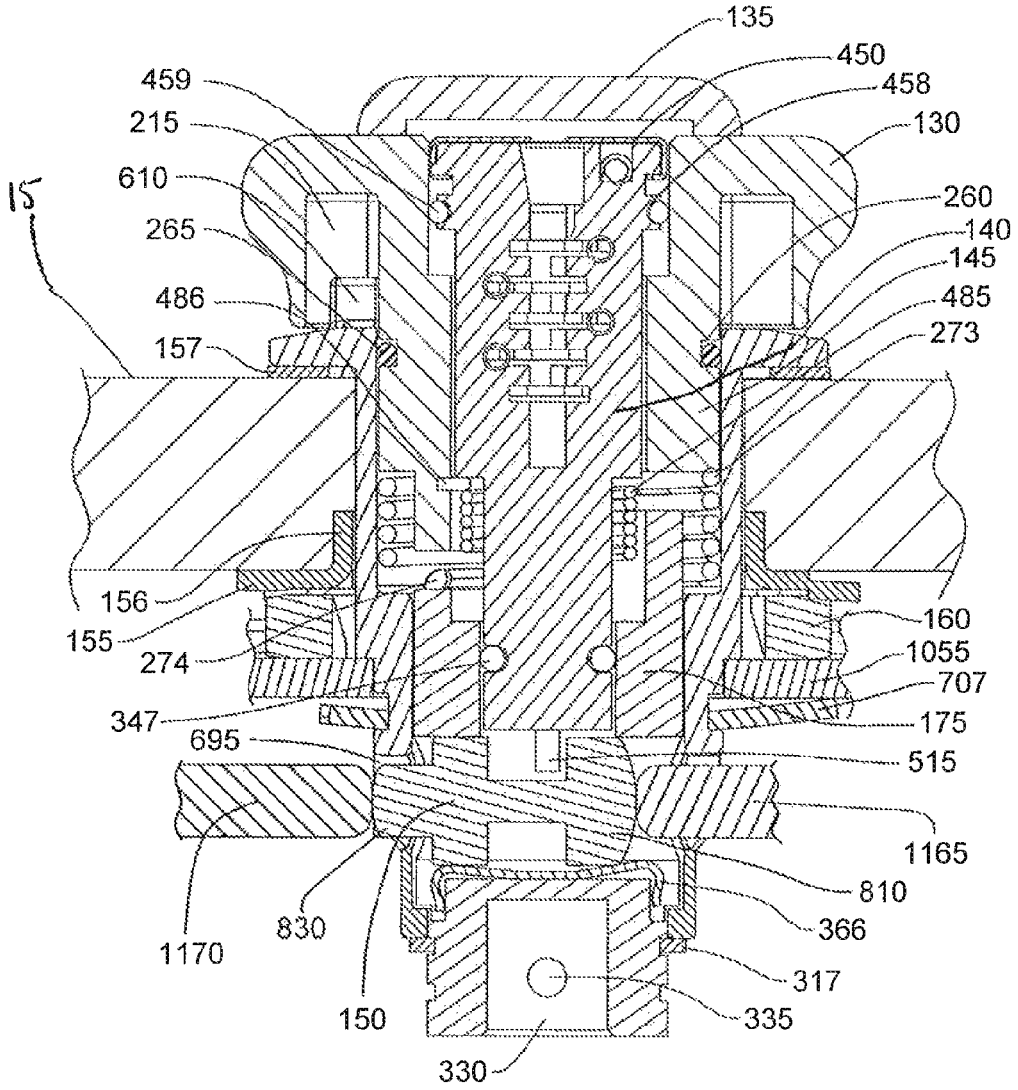
FIG. 29 is a cross sectional view of the locking handle and power module assembly in the locked position.
Figure 33:
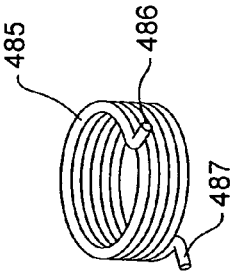
FIG. 33 is a perspective view of a key cylinder return spring of FIGS. 29-32.

Axially adjacent to the tumbler portion 460, a distal cylindrical end portion 475 extends. The cylindrical end portion 475 has a smaller diameter than the tumbler portion 460. A partial cylindrical flange or rib 480 extends distally from the tumbler portion 460, over the distal cylindrical portion 475, forming a gap 490 underneath a rib overhang along the peripheral rib edge 491. The flange 480 includes a proximal first notch 495 and distal second notch 500 on opposing sides of the rib edge 491 for receiving end legs 486, 487 of a key cylinder return spring 485 (FIG. 33). The distal cylindrical portion 475 further includes an annular groove 505 for engagement with the U-clip 347 (FIG. 29). At the distal end 510 of the key cylinder assembly 145, a slide bolt engagement tab or drive pin 515 is formed. The slide bolt engagement tab 515 is generally aligned with the key slot 455 (FIG. 12) formed within the key cylinder assembly 145, and extends distally from the distal end 510 of the key cylinder assembly 145. The tab 515 is offset radially from the center of the end portion 475 so as to move along an arcuate path when the cylinder assembly 145 is rotated manually by a key.

Figure 34:
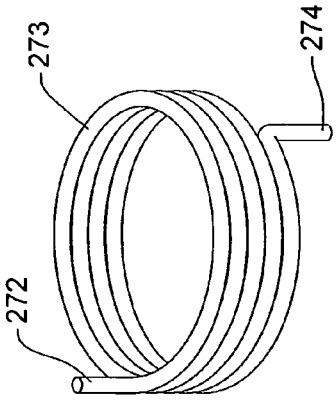
FIG. 34 is a perspective view of a handle return spring of FIGS. 29-32.
Figure 37:
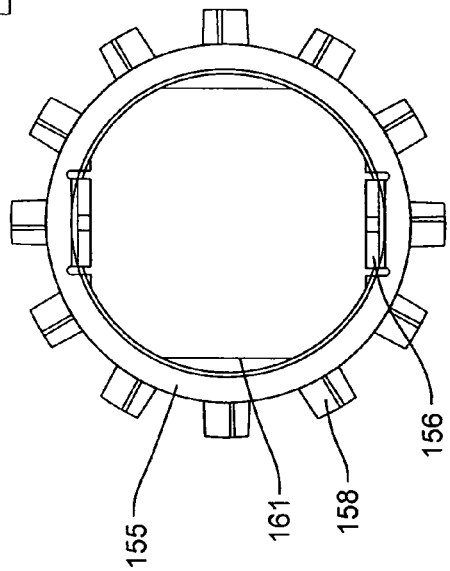
FIG. 37 is a front view of an anti-rotation washer of FIGS. 29-32.

To rotatably support the key cylinder assembly 145, the bushing 140 (FIGS. 13-16) is a generally hollow cylinder, having a proximal outer end 600 and a distal inner end 650. The outwardly arranged flange 605 is positioned at the proximal end 600, as shown in FIGS. 13-16 and projects radially outwardly. A rotation stop 610 extends proximally or axially from the face 615 of the flange 605 for seating in the handle cavity 220 above which thereby defines the stop limits for the handle rotation. The rotation stop 610 is adjacent to a bore or central passage 620 extending the length of the bushing 140. The central passage 620 includes two regions. The first outer region 625 has a larger first interior diameter 630. The second inner region 635 has a second interior diameter 640 smaller than the first diameter 630. The interior wall of the passage 620 forms a shoulder 645 defining the transition from the larger diameter 630 of the outer region 625 to the smaller diameter 640 of the inner region 635. A handle return spring pocket 647 is formed in the shoulder 645, for receiving a leg 274 of the handle return spring 273 (FIG. 34). The other leg 272 seats within the pocket 267 of the handle portion l30 as described above to normally maintain the handle portion 130 in an initial position while permitting rotation of the handle portion 130. The distal end 650 of the passage further narrows slightly to define a distal mouth 655 of the passage 620 which allows the slide bolt engagement tab 515 to project axially therethrough as seen in FIG. 29.

As to the exterior shape of the bushing 140, the exterior face 660 of the bushing 140 can be described as generally cylindrical. As shown in the bottom view of FIG. 16, the rounded "corners" 665 of the exterior 660 of the proximal portion of bushing 140 lie on and define a circle of a given radius. These rounded corners 665 are threaded (not shown) for receiving and threadedly engaging the bushing nut 160 seen in FIG. 3. Between each of the rounded corners 665, the external face 660 of the bushing 140 forms diametrically opposed flat faces 670.

The external face 675 of the end portion of the bushing 140 likewise includes rounded "corners" 680 and flat faces 685 therebetween. In at least one of the flat faces 685, a guidance key or groove 690 is provided. In the pair of opposing flat faces 685 adjacent to the guidance key 690, a passage 695 is provided, passing transversely or sidewardly through the distal portion of the bushing 140. Axially inwardly of this transverse passage 695, a concave trough 700 extends axially from a respective one of the passages 695, which trough 700 is formed on the outer face 685 of the end portion of the bushing 140 and extends to the distal end 650 of the bushing 140. Further, a circumferential groove 705 is provided at an outer end 710 of the distal portion of the bushing 140, for optionally receiving a snap ring 707 (FIG. 29) which optionally holds the power module 120 on the handle assembly 110 when mounted thereon.

Figure 38:
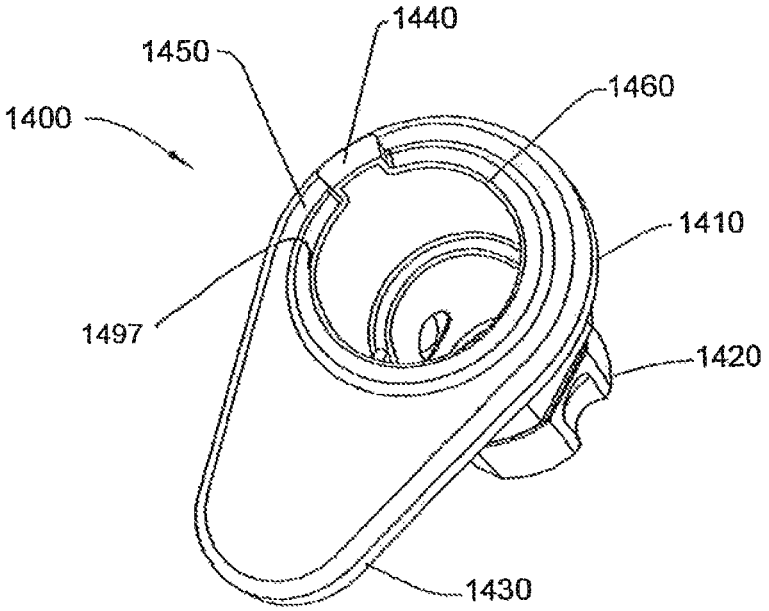
FIG. 38 is a perspective view of a bushing for a locking handle assembly according to a further embodiment of the invention.
Figure 39:
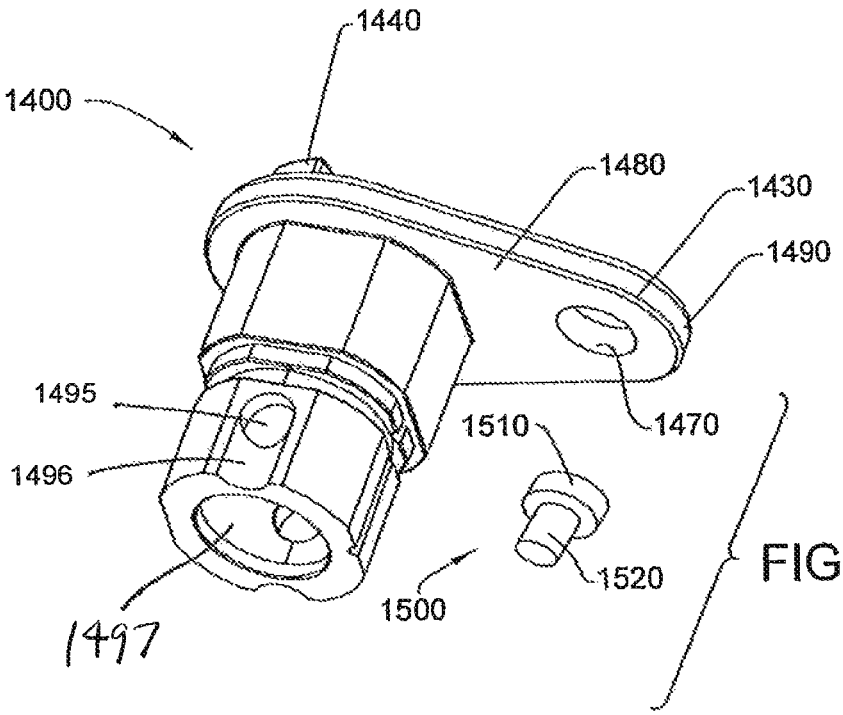
FIG. 39 is a reverse perspective view of the bushing of FIG. 38.

Referring to FIGS. 38 and 39, a preferred, alternative embodiment of a bushing 1400 is provided. The bushing 1400 has an outer end 1410 and a distal inner end 1420. The proximal end 1410 is formed with a teardrop-shaped radial extension arm or flange 1430. The shape of the flange 1430 substantially correlates to the shape of the gripping portion 170 of the handle 130, so that when the handle assembly 110 is assembled, the gripping portion 170 of the handle 130 substantially overlies the entirety of the flange 1430. A rotation stop 1440 extends axially from the proximal face 1450 of the bushing 1400 adjacent to the central passage 1460 to limit rotation of the handle 130 when received in handle cavity 220. Referring to FIG. 39, a blind bore or cavity 1470, generally cylindrical in nature, is formed in an underside 1480 of a free end 1490 of the flange 1430. The cavity 1470 is configured for receiving an anti-rotation stop projection or pin 1500. The pin 1500 is illustrated as comprising an enlarged head 1510 for fitting into the cavity 1470 and a cylindrical shank portion 1520 having a smaller diameter than the head 1510 which seats in the cover 7 and prevents relative rotation of the bushing 1400. It is also conceived that the pin 1500 would have a uniform diameter along its full length, extending from the cavity 1470. The remainder of the bushing 1400 is structurally identical to the bushing 140 described above. In use, the end closure panel 15 receiving the locking handle assembly 110 would include a primary aperture like aperture 16 for receiving the locking handle assembly 110, and a smaller secondary aperture 1525 (FIG. 44) for closely receiving the pin 1500 in a locking fashion. By this arrangement, the bushing 1400 is prevented from rotating within the primary aperture 16 of the closure panel 7 by the action of the anti-rotation or locking pin 1500. The bushing 1400 is further secured to the closure panel 7 by a bushing nut 160 with or without an anti-rotation washer 155 as described elsewhere herein.

Figure 17:
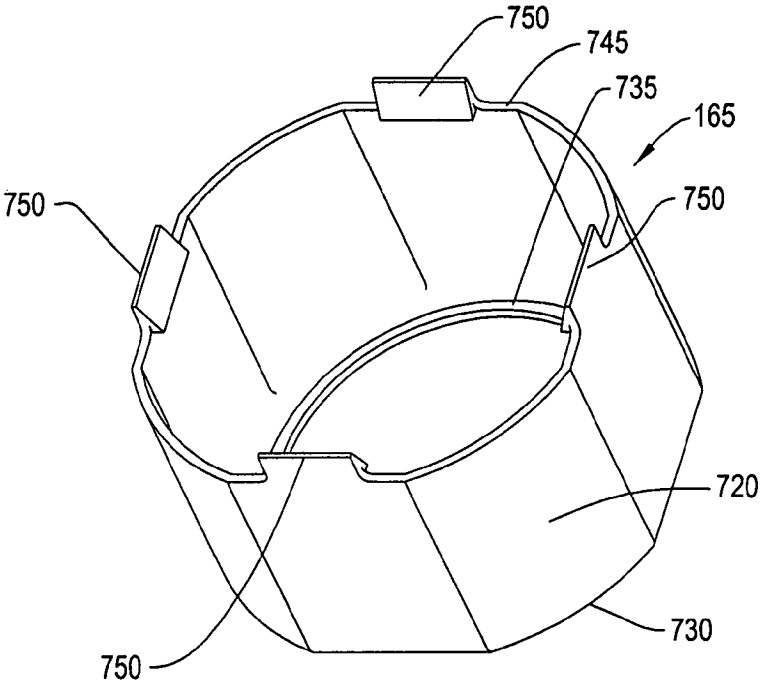
FIG. 17 is a perspective view of a dust cover cap of the locking handle assembly of FIGS. 2 and 3.
Figure 18:
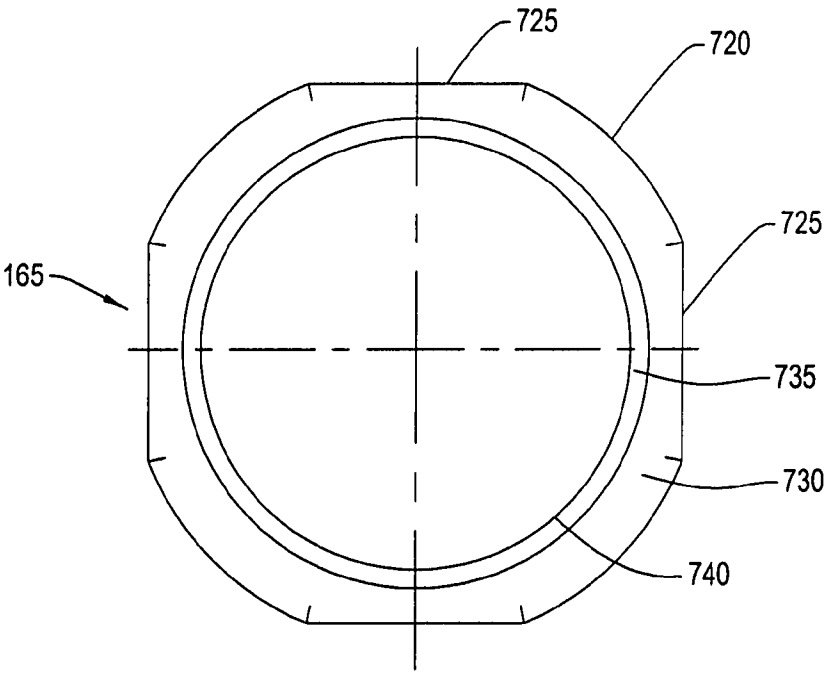
FIG. 18 is a bottom view of the dust cover cap of FIG. 17.

To enclose the above components, the dust cover cap 165, shown in FIGS. 2 and 17-18, is formed as a generally octagonal cylindrical sleeve having rounded "corners" 720 and flat sides 725, substantially corresponding to the cross section of the distal portion of the bushing 140. At a distal end 730 of the dust cover cap 165, a shoulder 735 is provided, forming a round opening 740 slightly larger than the opening 665 in the distal end 650 of the bushing 140. At the proximal end 745 of the dust cover cap 165, inwardly directed prongs or snap locking tabs 750 are provided. The prongs 750 are configured to engage the circumferential groove 705 adjacent the end 710 of the outer end portion 675 of the bushing 140 (FIG. 15), to removably attach the dust cover cap 165 onto the end portion of the bushing 140 as seen in FIG. 3.

Figure 19:
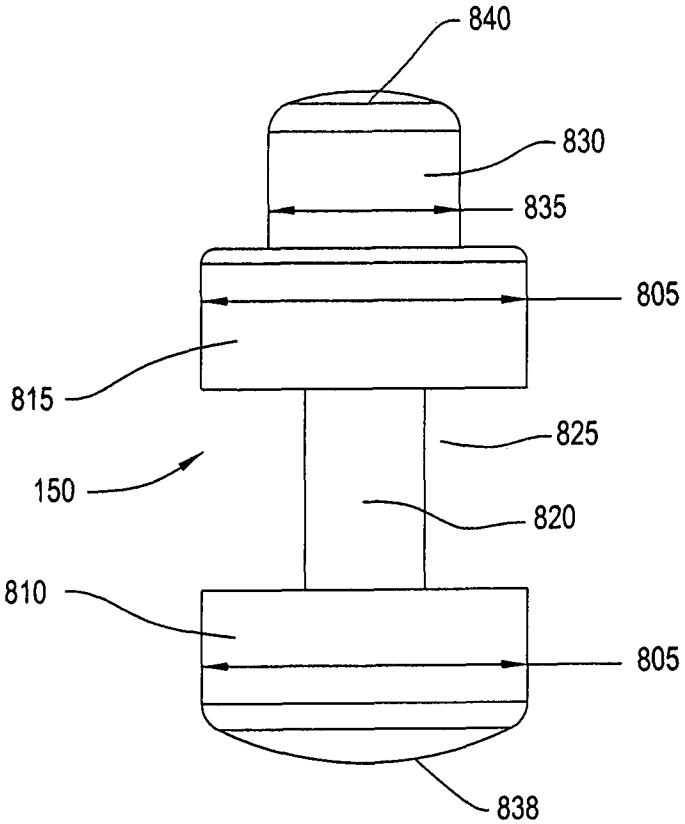
FIG. 19 is a plan view of a slide bolt of the locking handle assembly of FIGS. 2 and 3.

The above components serve to drive the slide bolt 150 for locking and unlocking. The slide bolt 150, as shown in FIG. 19 (and also in the cross sections of FIGS. 3 and 29-32), is cylindrical, having a primary diameter 805, defining a first portion 810 and a third portion 815. The first and third portions 810, 815 are connected by a second, reduced portion 820. The reduced portion 820 forms the basis for an annular cavity 825 between the first and third portions 810, 815 of the slide bolt 150. The slide bolt 150 fits into transverse passage 360. The diameter 805 of the first and third portions 810, 815 is defined so as to provide smooth movement within the transverse passage 360 of the handle shaft 175. A fourth portion 830 of the slide bolt 150, opposite from the first portion 810, is formed with a predefined diameter 835 for engaging the passage 695 in the bushing 140 or similar passage 1495 in bushing 1400 to selectively prevent rotation of handle 130 when engaged with the bushing 140 or 1400. The external faces 838, 840 of the first and fourth portions 810, 830 of the slide bolt 150 are formed with a specified radius to provide clearance within the bushing 140 or 1400 while housed completely within the transverse passage 360 of the shaft 175. Operation of the slide bolt 150 will be described further herein.

Figure 20:
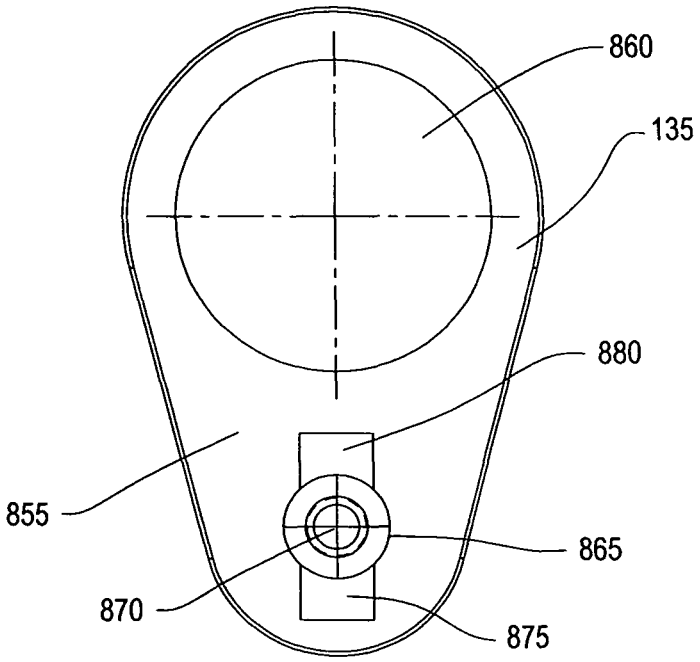
FIG. 20 is a bottom view of a cover of the locking handle assembly of FIGS. 2 and 3.
Figure 21:
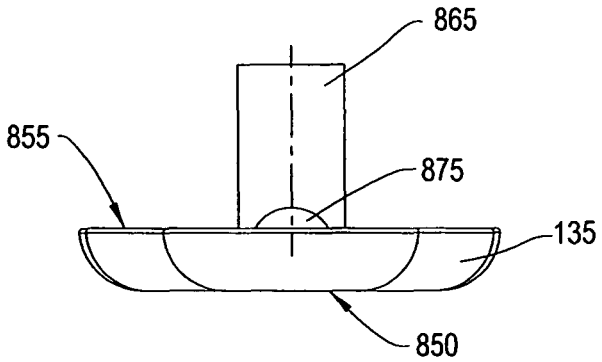
FIG. 21 is an end view of the cover of FIG. 20.

To selectively enclose the exterior key slot of the cylinder assembly 145, the cover 135, as shown in FIGS. 20-21, has a tear-drop shape to match the gripping portion 170 of the handle 130 and is rotatably mounted on the handle 130 so to swing open and closed to provide access to the key cylinder. The cover 135 has an outer face 850 and an inner face 855. The inner face includes a cylindrical depression 860 (see also FIG. 3) which covers the cylinder assembly 145. A cylindrical post 865 extends normally from the inner face 855 and fits in handle aperture 190 in rotatable engagement therewith. The post 865 includes an internal aperture 870. A pair of convex ridges 875, 880 extend from the inner face 855 on opposing sides of the post 865 so as to seat within the handle recesses 195 and 200, and in alignment with a longitudinal axis of the cover 135. The ridges 875, 880 and recesses 195, 200 have cooperating arcuate surfaces which effect a camming action during swinging of the cover 135 and thereby lift the cover 135 upwardly to permit continued swinging movement of the cover 135 that exposes the lock cylinder 145. A coil spring 885 resiliently resists this lifting movement while a screw fastener 890 prevents removal of the cover 135 from handle 130. In this manner, the handle 130 can be manually locked and unlocked by the key K.

While the handle 130 allows for manual locking and unlocking, the power module 120 illustrated in FIG. 1A and FIGS. 22-28, and is a preferred addition to the locking handle assembly 110 for providing remote electrical locking and unlocking capability to the locking handle assembly 110. The power lock assembly 120 includes a solenoid housing and frame 1000, a cover 1010, a lock solenoid 1020 (FIG. 28), a drive plate or slider plate 1030, and a manual lock/unlock knob 1040. The frame 1000 mounts to the distal end 650 of the bushing 140 to align for engagement with the locking handle assembly 110, as will be further described below.

The solenoid housing and frame 1000 includes a housing portion 1050 and a frame portion 1055. The frame portion 1055 extends laterally of the housing portion 1050 and is connected to the housing portion 1050 by a bridge portion 1060. A slider mounting plate 1065 (FIG. 25) extends over the bridge portion 1060, from the housing portion 1050, and further extends over the frame portion 1055. The mounting plate 1065 includes two slider mounting posts 1070, 1075. In the region of the bridge portion 1060, the slider mounting plate 1065 includes a groove 1080 aligned with a notch 1085 in the housing portion 1050.

The housing portion 1050 defines an interior cavity 1090 for receiving the solenoid 1020 (FIG. 28), and includes a power connection recess 1095 formed distally from the frame portion 1055 and the notch 1085 to accommodate a power connection to the solenoid 1020.

The frame portion 1055 is substantially flat, and includes a central, generally octagonal opening 1100. The periphery of the opening 1100 includes flat sections 1105 and curved sections 1110, substantially corresponding to the exterior configuration of the distal end 650 of the bushing 140. One of the flat portions 1105 includes a guidance key 1115 for engaging the groove 690 formed in the distal end 650 of the bushing 140. Each of the posts 1070, 1075 includes a respective collar portion 1130, 1135.

The slider plate 1030 (FIGS. 26 and 27) is generally rectangular in configuration. A pair of oval slots 1150, 1155 are arranged parallel to a longitudinal axis of the slider plate 1030, along an upper edge thereof, to define stop limits for sliding movement of the slider plate 1030. A cutout portion 1160 is arranged opposite the oval slots 1150, 1155. The cutout portion is bounded by a locking projection 1165 and an unlocking projection 1170, each directed in the longitudinal direction of the sliding plate 1030 and along a lower edge 1175 thereof. At a proximal end 1180 of the slider plate 1030, relative to the housing 1050, a raised flange portion 1185 is provided. The raised flange 1185 includes an aperture 1190 and further defines a recess 1195 on an undersurface thereof adapted to be driven by the solenoid 1020.

Figure 22:
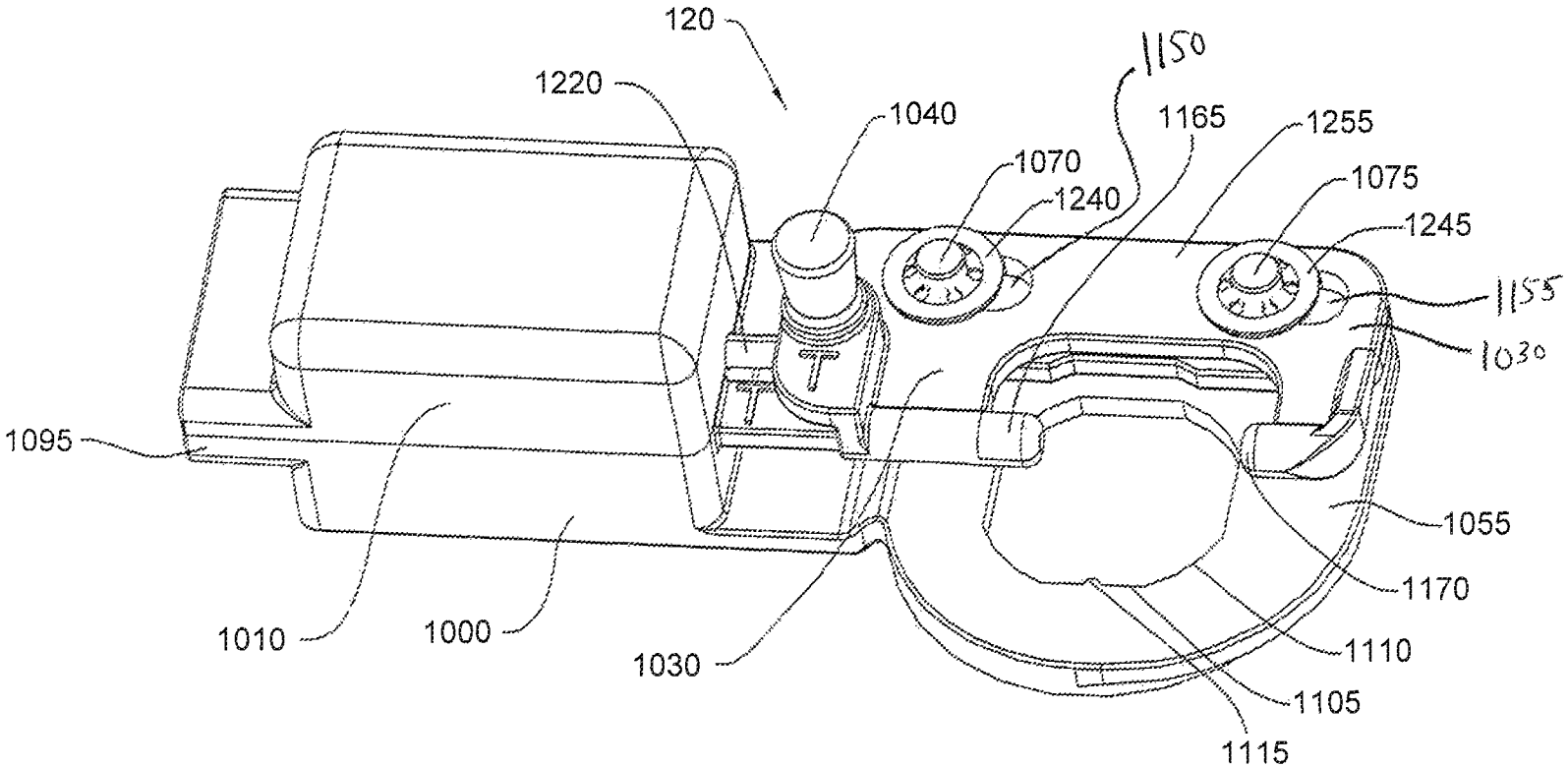
FIG. 22 is a perspective view of the power module of the assembly of FIG. 1A according to the invention.
Figure 23:
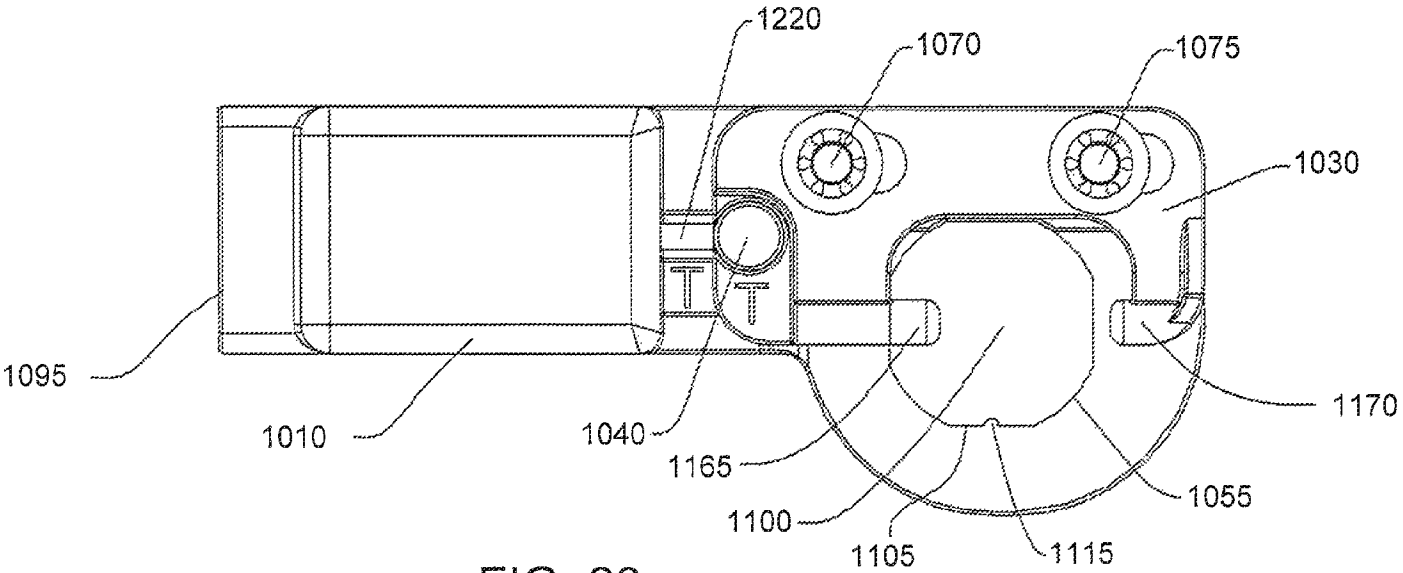
FIG. 23 is a front view of the power module of FIG. 22.
Figure 24:
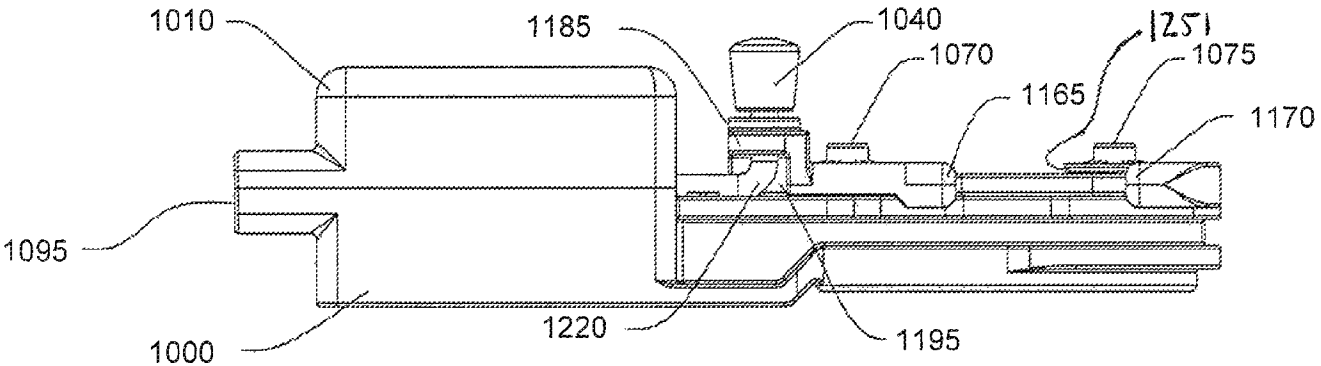
FIG. 24 is a bottom view of the power module of FIGS. 22 and 23.
Figure 25:
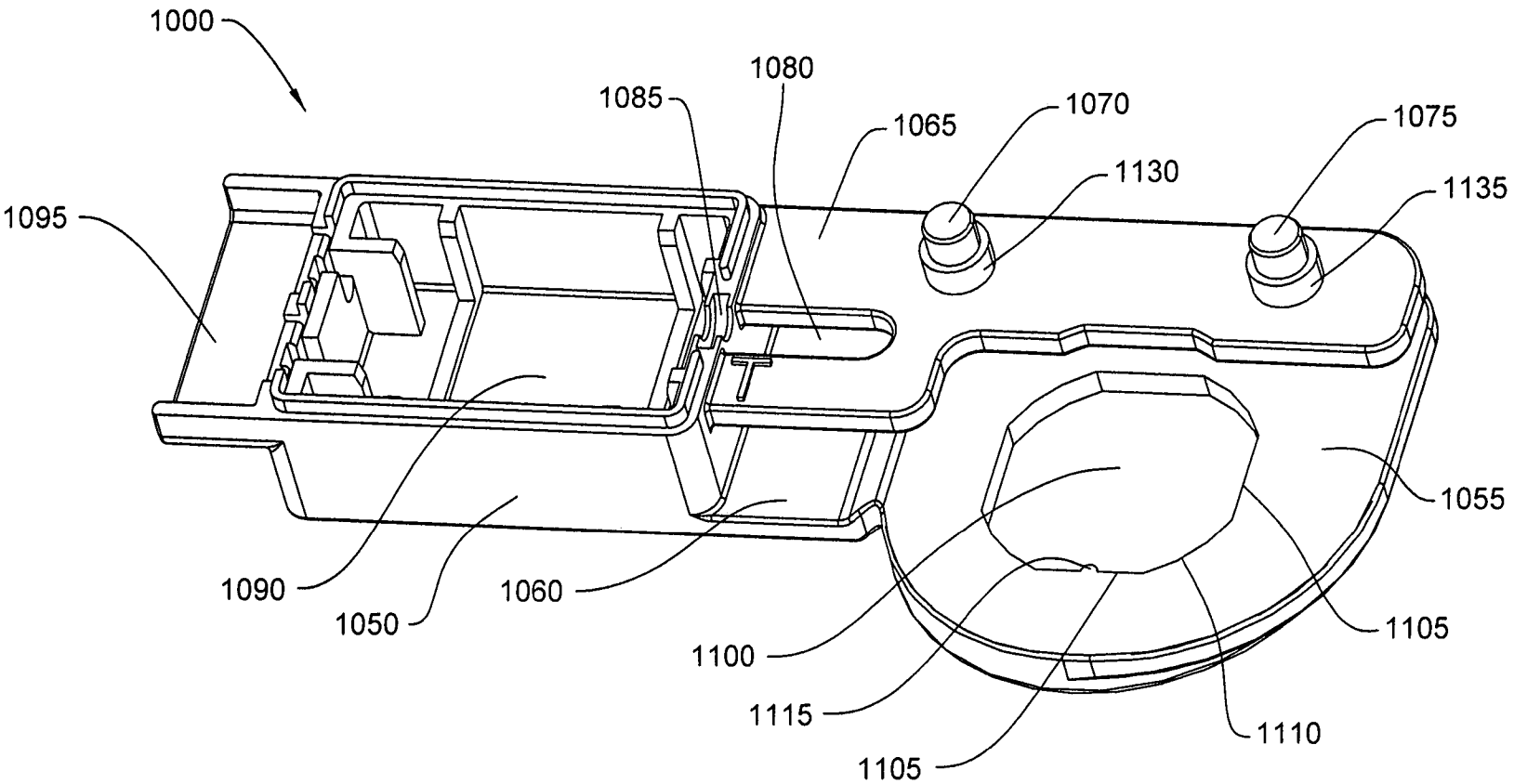
FIG. 25 is a perspective view of a solenoid housing and frame of the power module of FIGS. 22-24.
Figure 27:
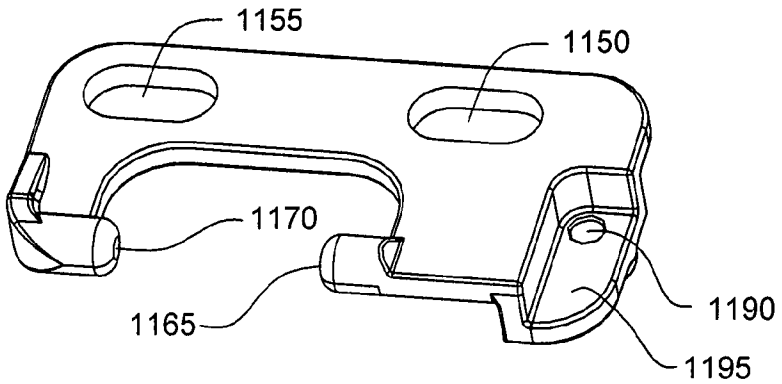
FIG. 27 is a reverse perspective view of the slider of FIG. 26.
Figure 26:
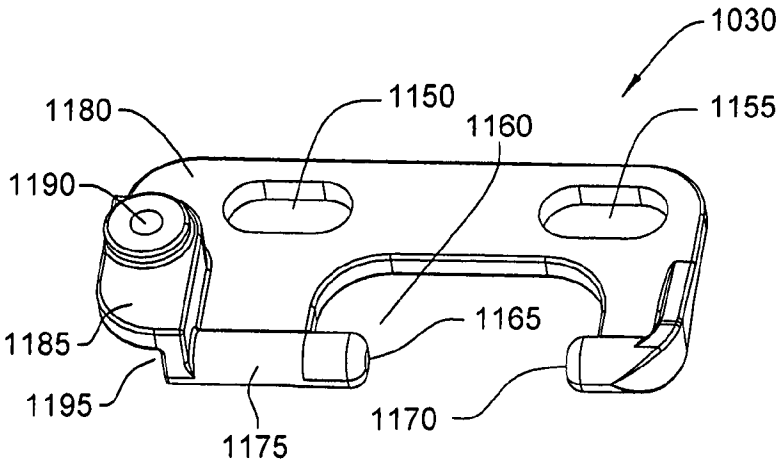
FIG. 26 is a perspective view of a slider of the power module of FIGS. 22-25.
Figure 28:
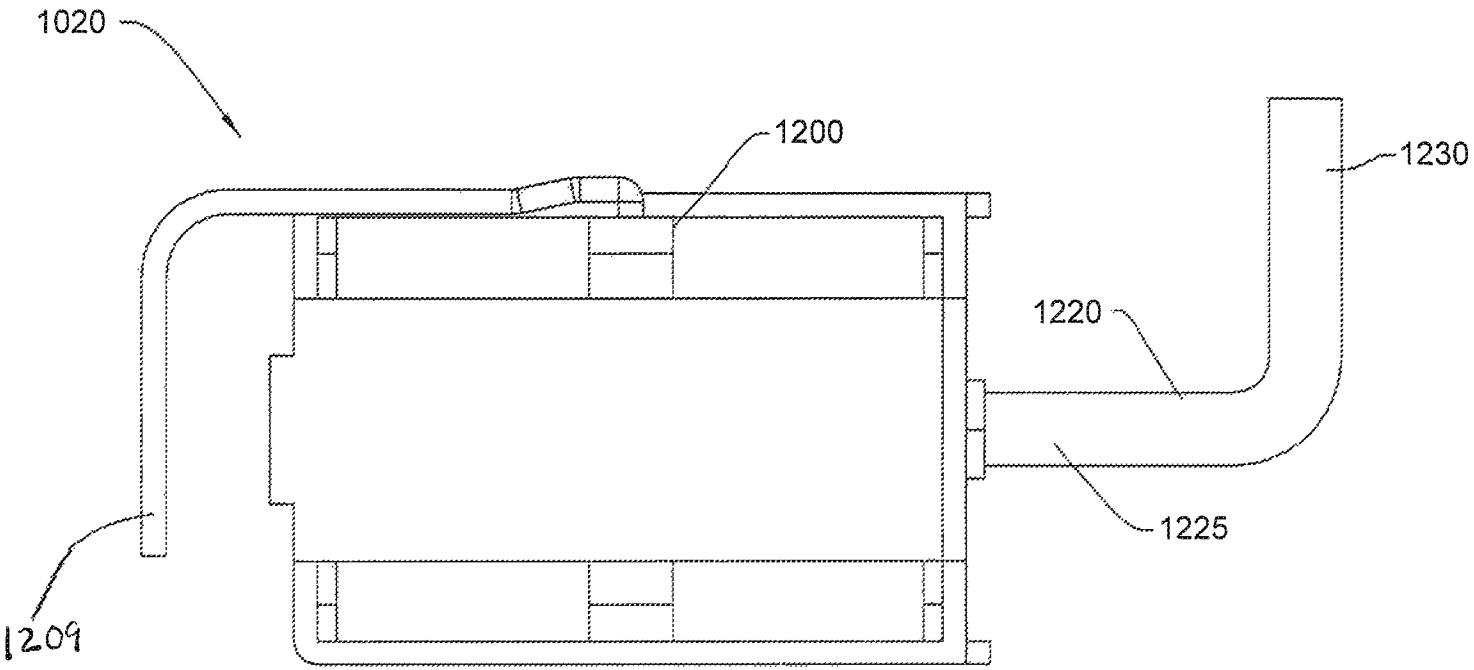
FIG. 28 is a side view of a solenoid for the power module according to FIGS. 22-27.

Referring to FIG. 28, the solenoid 1020 includes a main drive body 1200, electrical input 1209, and reciprocating actuation arm 1220. The actuation arm 1220 includes a longitudinal portion 1225 for reciprocal movement into and out of the body 1200 and a vertical drive portion 1230. As shown in FIGS. 22-24, the actuator 1220 extends distally from the housing 1050 toward the opening 1100 for engagement with the slider plate 1030. The vertical portion 1230 turns away from the face of the slide frame 1000 and passes through the aperture 1190 in the slide plate 1030 so that the plate 1030 and arm 1220 reciprocate together. The vertical portion 1230 is capped by the unlock knob 1040.

The slider plate 1030 is slidably received on the face of the slide frame 1000, with the slide plate posts 1070, 1075 each passing through the respective slot 1150, 1155. The slide plate 1030 is retained on the slide frame by push nuts 1240, 1245 (FIGS. 22 and 23). A washer 1251 is interposed between each push nut 1240, 1245 and the face 1255 of the slide plate 1030.

Figure 30:
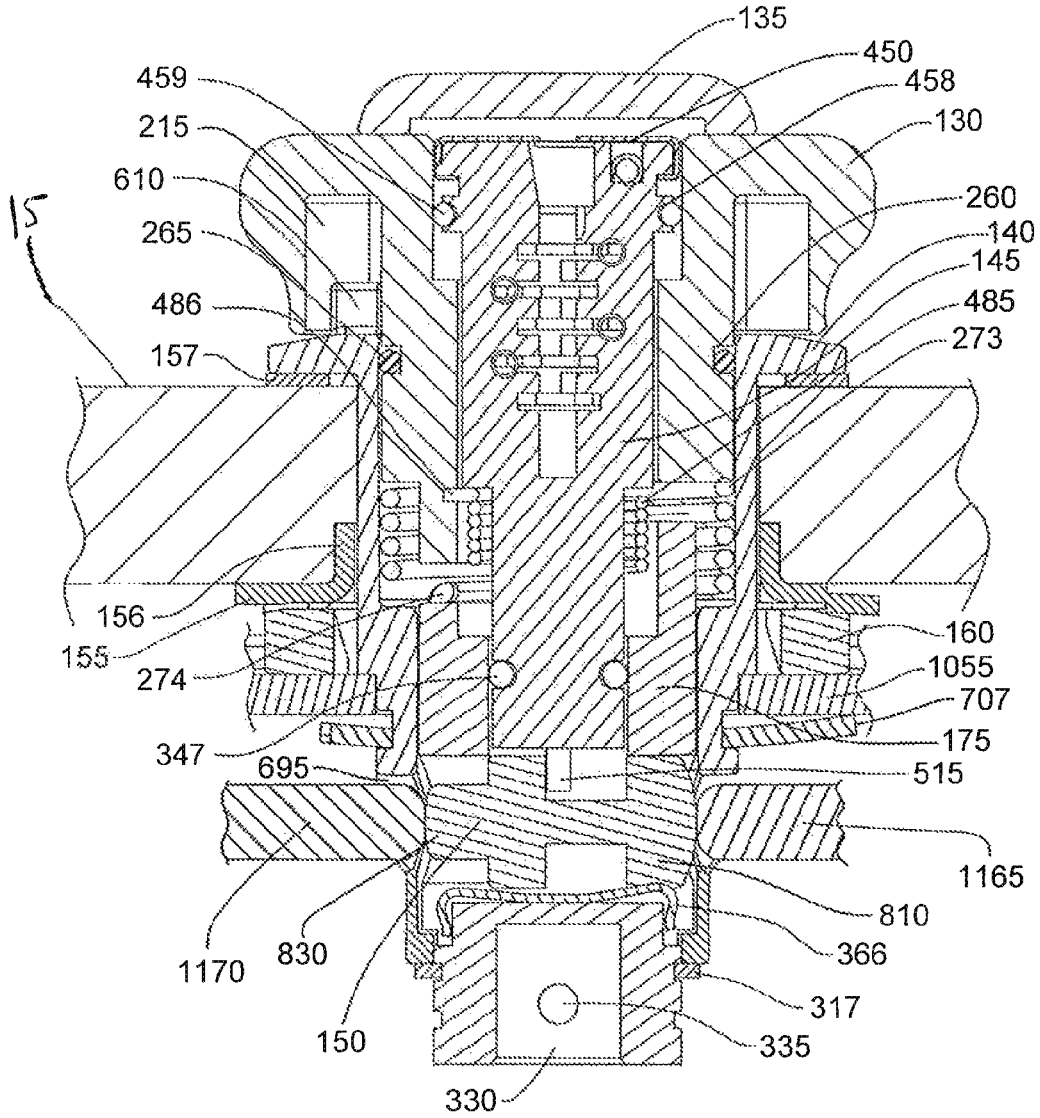
FIG. 30 is a cross sectional view of the locking handle and power module assembly in the unlocked position.

Under the powered action of the solenoid 1020 which is powered by 12 volt pulses or power from the vehicle electrical system, the actuation arm 1220 selectively moves the slider plate 1030 either toward or away from the housing portion 1050. In the disclosed embodiment, movement of the slider plate 1030 proximally to or toward the housing portion 1050 will extend the unlocking projection 1170 into the opening 1100. As will be described below, this movement will effect an unlocking of the handle assembly 110 (FIG. 30). Conversely, distal away movement of the slider plate 1030 will extend the locking projection 1165 into the opening 1100 (FIG. 29). This movement will effect a locking of the handle assembly 110.

Assembly

A detailed cross-section of the locking handle assembly 110 is shown in FIG. 3. To assemble the locking handle assembly 110, the first step is to insert the slide bolt detent spring 366 into the keyhole portion 365 of the transverse opening 360 of the shaft 175. The slide bolt 150 is then inserted into the transverse passage 360 and centered so it does not extend beyond the exterior circumference of the shaft 175 of the handle 130, as in the "unlocked" orientation of FIG. 30.

O-ring 459 is placed in O-ring channel 458 on key cylinder assembly 145. The key cylinder return spring 485 (see also FIG. 33) is assembled onto the assembled key cylinder assembly 145 so that each leg 486, 487 of the key cylinder spring 485 engages the appropriate notch 495, 500 (FIG. 10) on the tumbler extension 480, placing the spring 485 under tension. The legs 486, 487 are aligned with the key cylinder return spring slots 410, 415 (FIG. 8) within the tumbler portion 385 of the shaft 250 of the handle 130. The key cylinder assembly 145 is then inserted into the central aperture of the handle 130 so that the slide bolt engaging tab 515 enters the gap 825 between the first and third portions 810, 815 of the slide bolt 150, and so that the circumferential groove 505 aligns with the apertures 345, 350 within the notch 340 of the shaft 175. The legs of the U-clip 347 are inserted through the apertures 345, 350, engaging the groove 505 to retain the key cylinder assembly 145 within the handle 130.

The cover 135 may then be assembled to the handle 130. As shown in FIG. 3, the post 865 is received in the aperture 190 in the narrow end 230 of the gripping portion 170 of the handle 130. With the post 865 received in the aperture 190, the ridges 875, 880 can be received in the pockets 195, 200 on the face 180 of the gripping portion 170. A compression spring 885 is placed over the post 865 within the cavity 220 and is secured on the post 865 by a threaded fastener 890. The internal aperture 870 can be pre-threaded, or threads formed by self-tapping by the fastener 890. The cover 135 is biased by the spring 885 toward the face 180 of the gripping portion 170, with the ridges 875, 880 in the pockets 195, 200. In the position shown in FIG. 3, the cylindrical cavity 860 is positioned over the aperture 185 holding the key cylinder assembly 145.

To install the handle 130, the O-ring 265 is placed within the annular groove 260 of the handle 130. The handle return spring 273 is also slid over the shaft 175 so that a first leg 272 is inserted into the hole 267 (FIG. 6) in the shoulder 268 of the shaft 175. The shaft 175 can then be inserted into the bushing 140, taking care to align the second leg 274 of the handle return spring 273 with the hole 647 in the shoulder 645 within the bushing 140 (FIG. 14) so that the handle 130 is normally based to its initial position. Snap ring 317 is clipped over the tip 280 of the shaft portion, into the first of the grooves 315 (FIG. 4) to hold the shaft 175 within the bushing 140.

The locking handle assembly 110 can now be inserted through opening 16 in closure panel 15. First, gasket 157 is placed on an underside of the outwardly extending flange 605 of bushing 140. The shaft of the bushing 140 is then inserted through the opening in the closure panel 15. An anti-rotation washer 155 slides over the bushing 140, with flats 161 and wedges 156 engaging opposing bushing flat faces 685. A smooth washer 159 is placed over the anti-rotation washer 155, and bushing nut 160 is threaded onto the rounded corners 665 of the bushing 140 until the wedges 156 bite into the closure panel 15 and wedge between the aperture 16 in the closure panel 15 and the flat faces 685 of bushing 140. Teeth 158 engage the inner face 18 of the closure panel 15.

In a non-powered application, the dust cover 165 can then be applied to the distal portion of the bushing 140 so that the tip 380 of the handle 130 extends through the opening 740 of the dust cover 165, as shown in FIG. 2. In one configuration, a rotation disk (not shown) can be connected to a latching mechanism of the closure panel and is mounted on the tip 380 and secured by a second retaining clip (not shown) that is received in the distal slot 320. This disk would rotate with the handle 130. Other release mechanisms are available, which can be adapted to engage the square cavity 330 in the tip 280.

In a powered application, the locking handle assembly 110 is secured to the closure panel 15 as described above, but the dust cover 165 need not be employed. The distal end 650 of the bushing 140 is exposed. The power module 120 is slid over the distal end 650 of bushing 140 with the guidance key 1115 engaging the groove 690 to ensure proper orientation, as the power module 120 can be constructed for right or left side installation and therefore is adaptable to different configurations of closure. The troughs 700 on each side of the distal end 650 of the bushing 140 are provided so that the locking projection 1165 and the unlocking projection 1170 can pass over the distal portion of the bushing 140 to align with the passage 695. The frame 1055, when fully engaged onto the distal end 650 of the bushing 140, abuts the proximal end 710 of the distal portion, exposing the groove 705. The snap ring 707 can then be received within the groove 705, securing the power module 120 onto the locking handle assembly 110. The locking and unlocking projections 1165, 1170 are thus aligned with the passage 695 for engaging the slide bolt 150, as shown in FIGS. 29-32. The slide bolt 150 remains engageable by the key cylinder assembly 145.

Operation

In FIG. 29, the locking handle assembly 110 is shown in the locked position, with no key inserted in the key cylinder 145, and with the key cylinder 145 in the centered position, biased into this position by the key cylinder return spring 485. In this position, the slide bolt engagement tab 515 is centered, allowing the slide bolt 150 to slide freely from the locked position (FIG. 29) to the unlocked position (FIG. 30). The locking projection 1165 of the power module 120 extends through the passage 695 to maintain or push the slide bolt 150 to the left. In this locked position, the end portion 830 of the slide bolt 150 extends through the passage 695, preventing relative rotation of the shaft 175 within the bushing 140.

Referring to FIG. 30, the unlocking projection 1170 has been actuated to extend into the passage 695 so that the end portion 830 of the slide bolt 150 is fully received or retracted within the shaft 175 of the handle 130. The locking portion 1165 is simultaneously withdrawn from the passage 695, thereby allowing complete freedom of rotation of the shaft 175 within the bushing 140 by the handle 130.

Figure 31:
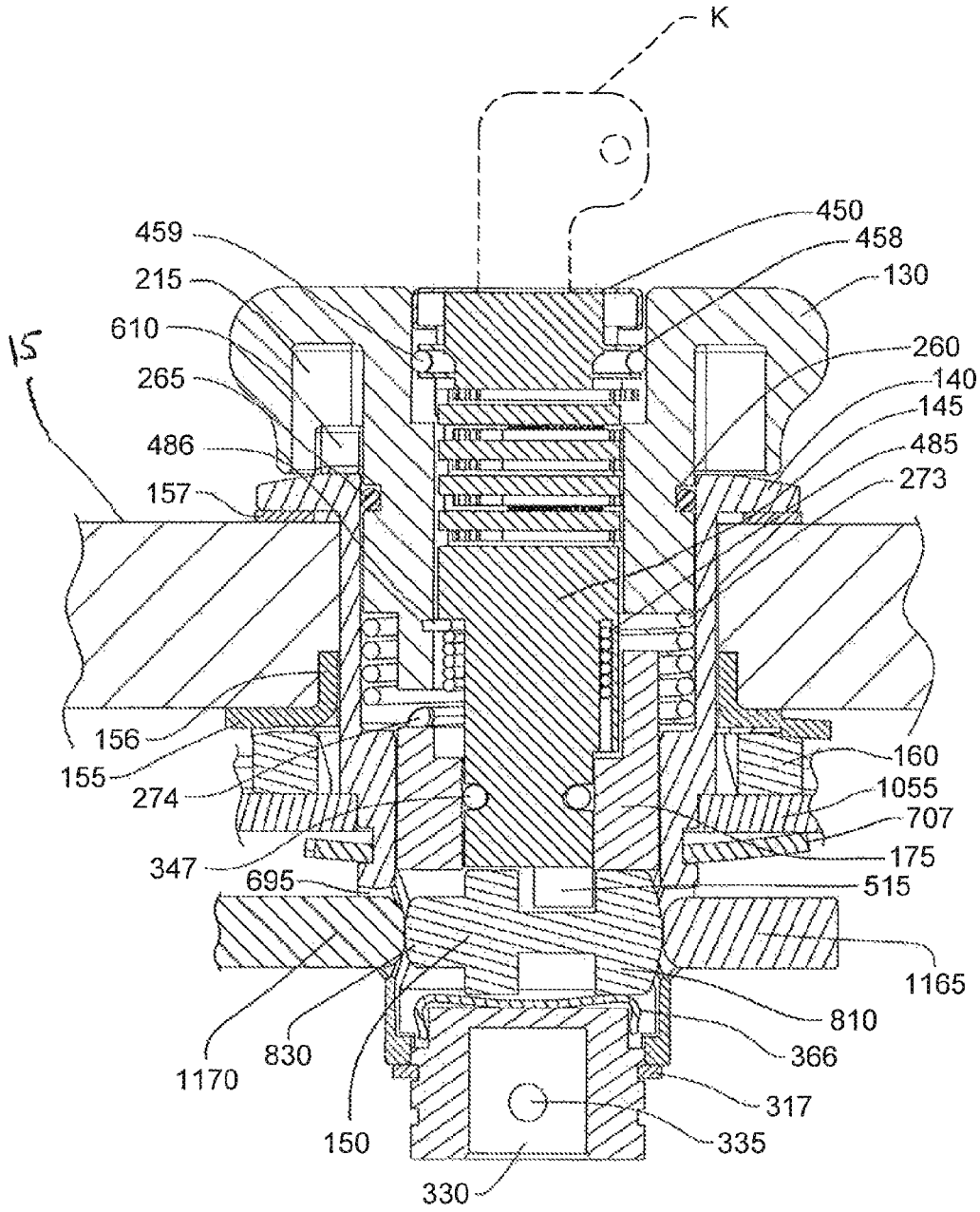
FIG. 31 is a cross sectional view of the locking handle and power module assembly with the key cylinder rotated in the locking position.
Figure 32:
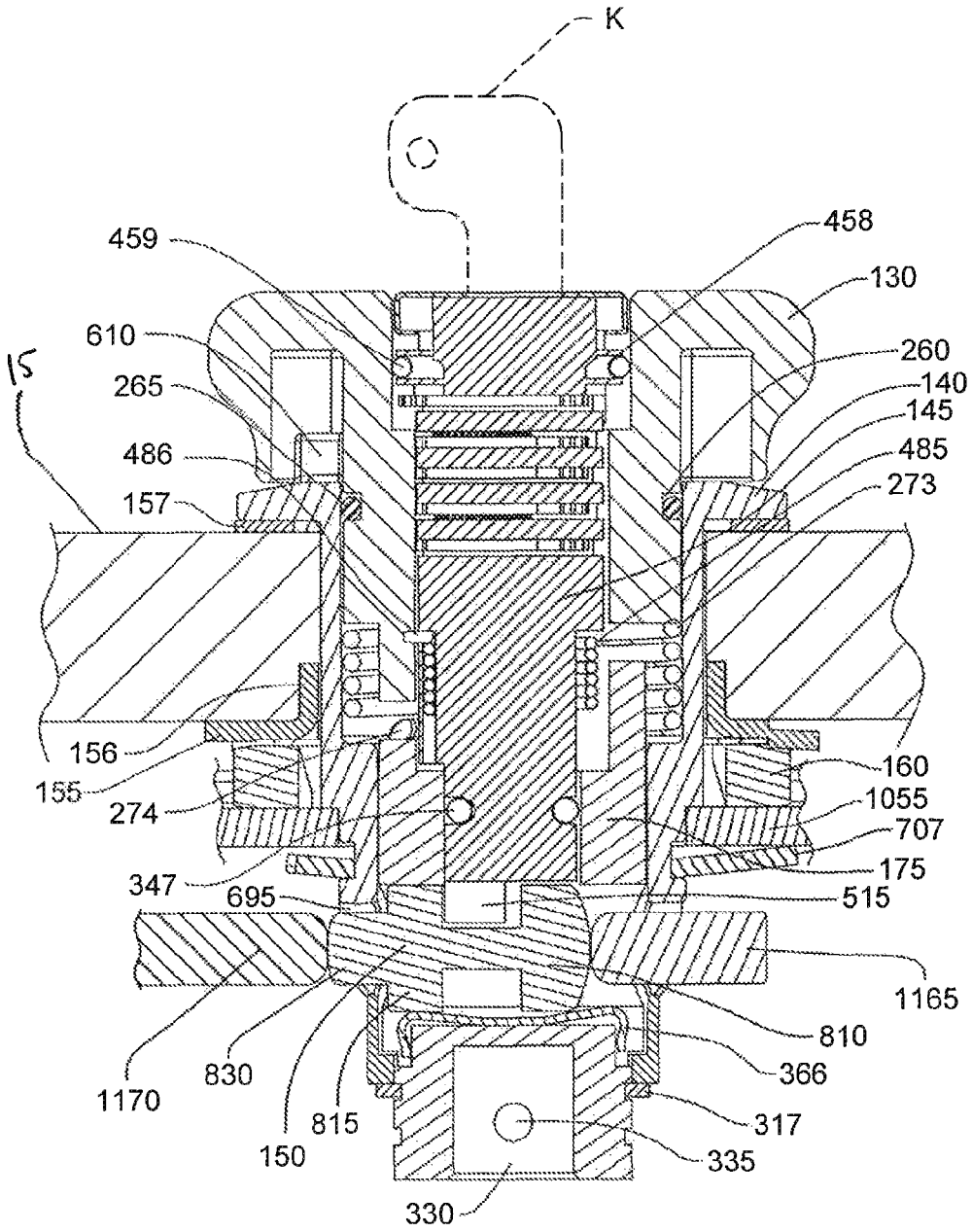
FIG. 32 is a cross sectional view of the locking handle and power module assembly with the key cylinder in the unlocking position.

In order to operate the locking handle assembly 110 using a key, it is necessary to expose the key cylinder assembly 145. The cover 135 need only be pushed to the side and rotated about the post 865. A ramping action between the ridges 875, 880 and the pockets 195, 200 will compress the spring 885 and lift the cover 135 above the face 180 of the gripping portion 170 of the handle 130, to provide clearance and prevent scratching of the face 180. When the cover has rotated 180° about the post 865, the ridges 875, 880 will drop into the opposite respective pocket 195, 200, and remain in the uncovered position until manually returned to the covered position of FIG. 3. In FIGS. 31 and 32, the cover 135 has been rotated to expose the key cylinder 145 and is not shown.

FIG. 31 shows a key K engaged in the key cylinder 145 and rotating the key cylinder 145. This rotation of the key cylinder 145 causes the slide bolt engagement tab 515 to engage the first portion 810 of the slide bolt 150 to center the slide bolt 150 within the shaft 175. The first portion 810 of the slide bolt 150 presses the locking projection 1165 out of the shaft 175 to allow free rotation of the handle 110.

In FIG. 32, the key K is shown inserted into the key cylinder 145, but rotated in the opposite direction. Rotation of the key cylinder assembly 145 by the key K causes the slide bolt engagement tab 515 to be pressed against the third portion 815 of the slide bolt 150 to extend the end portion 830 through the passage 695, thus preventing rotation of the handle 130. The extension of the end portion 830 presses against the unlocking projection 1170 to displace it so that the end portion 830 can occupy the passage 695. Displacement of the unlocking projection 1170 simultaneously draws the opposed locking projection 1165 into the passage 695 to further secure the shaft 175 against rotation relative to the bushing 140.

Figure 40:
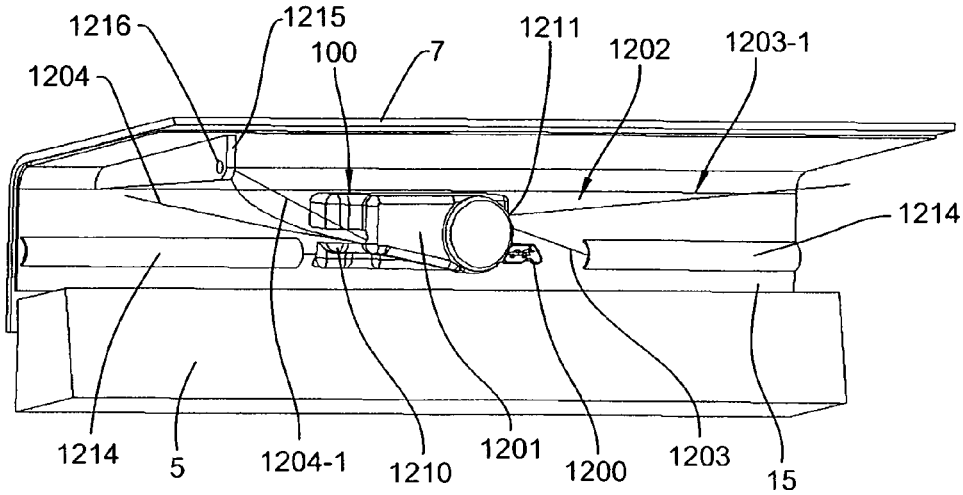
FIG. 40 is an inside perspective view of a locking handle and power module assembly mounted to the inside of a tonneau cover and disposed adjacent a bed portion of a pickup truck.
Figure 46:
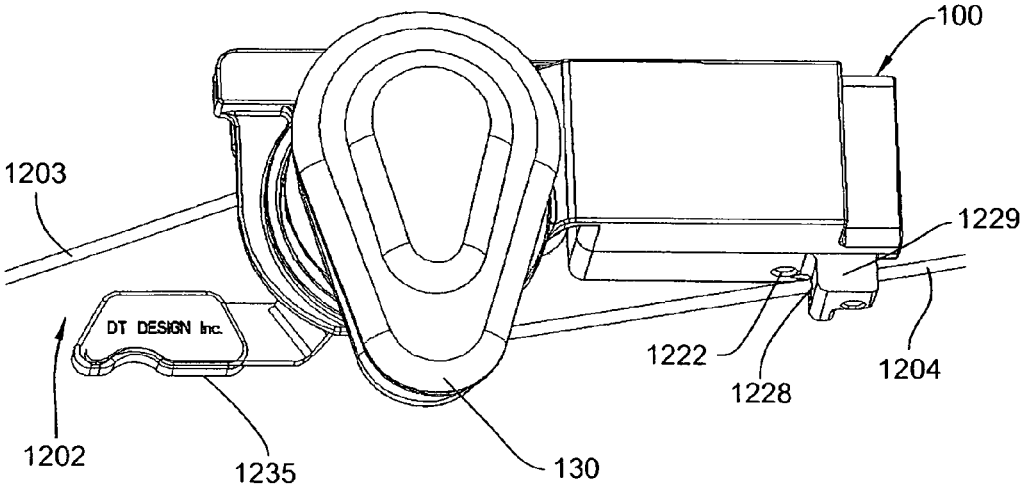
FIG. 46 is a perspective view showing actuator cables connected to the locking handle and power module assembly.

In a preferred embodiment of the invention, the above-described locking handle and power module assembly 100 is mounted to the end wall 15 of the tonneau cover 7 according to the above-described mounting procedures. The handle assembly 100 preferably also includes a manually operable release handle 1200 which projects out of a main cover 1201, which cover 1201 is provided as seen in FIG. 40 so as to almost fully enclose the locking handle and power module assembly 100. This release handle assembly 1200 is drivingly connected to a latching mechanism 1202, which latching mechanism 1202 comprises two actuator cables 1203 and 1204 (FIGS. 40 and 46-47) wherein the release handle assembly 1200 may be automatically operated by its interconnection to the locking handle assembly 110 which may be manually operated from the exterior of the tonneau cover 7 by rotation of the handle portion 130. The release handle assembly 1200 also is accessible from the interior of the tonneau cover 7 and may be manually rotated from the interior of the tonneau cover 7 so as to actuate the cables 1203 and 1204 independently of the exterior handle 130 and even if the handle 130 is locked. This allows for emergency release of the inventive handle assembly 130 even under a locked condition.

The assembly 100 is preferably formed with the above-described bushing 1400 which includes the anti-rotation in 1500 which projects from the bushing and engages a secondary aperture 1525 (FIG. 44) that is formed on the exterior of the tonneau cover end wall 15 to prevent unwanted rotation of the bushing 1400 within the end wall 15.

In this preferred embodiment, the bushing 1400 includes side grooves 1496, which grooves 1496 include the apertures 1495 on the opposite sides of the bushing 1400 that align with each opposite end of the transverse passage 360 in the handle shaft 175 described above so as to permit the power module 120 to operate the slide bolt 150 as also described above. Hence, bushing 1400 also has a bore or opening 1497 (FIGS. 38 and 39) wherein the shaft portion 175 project out of the bushing opening 1497 for mounting of the release handle assembly 1200 thereon. Hence, operation of the release handle assembly 1200 causes rotation of the handle shaft 175.

Figure 51:
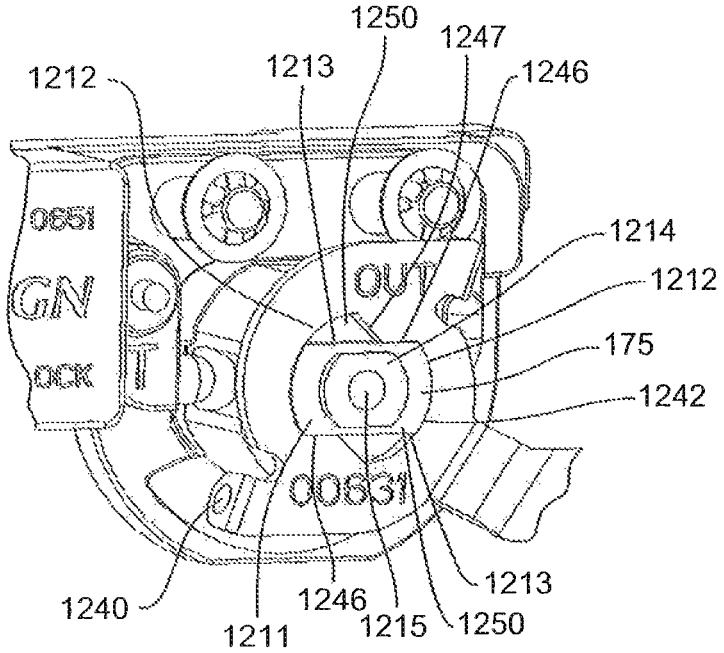
FIG. 51 is an enlarged rear perspective view of the release handle mounted to the locking handle assembly.
Figure 52:
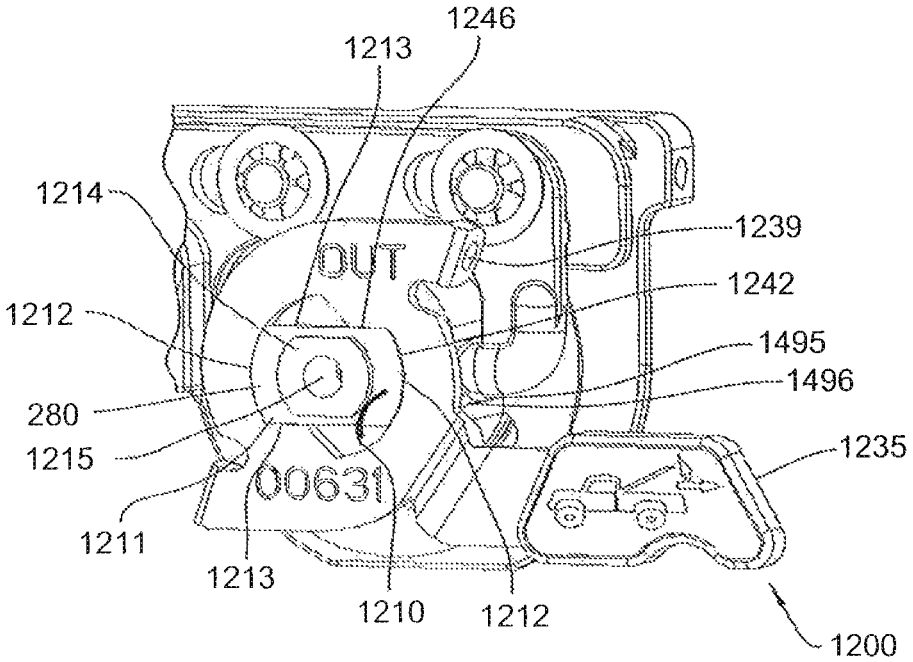
FIG. 52 is a further perspective view of the release handle mounted to the locking handle assembly.

Referring to FIGS. 51 and 52, the shaft portion 175 of the handle 130 has a modified construction in that the tip portion 280 is formed with a flat end face 1210 and a mounting hub 1211 projecting therefrom. The mounting hub 1211 has opposite arcuate side edges 1212 and a pair of straight edges 1213 on the top and bottom thereof. In the center of the hub 1211, a short hub extension 1214 is provided which also has two arcuate edges and a pair of straight edges on the top and bottom thereof. The center of the hub extension 1214 includes a fastener bore 1215 for mounting the release handle assembly 1200 thereon as will be described further hereinafter. As such, the release handle assembly 1200 is typically disposed within the interior storage compartment of the truck bed portion 5, and is accessible from this space to independently operate the latching mechanism 1202 even if the handle assembly 110 is in a locked condition, and without require operation of either the handle 130 or the power module 120. The primary function served by the release handle assembly 1200 is that it would allow release of the latching mechanism 1202 and opening of the tonneau cover 7, for example, if a person was trapped in the storage compartment.

First as to the cover 1201, this cover 1201 encloses the entire locking handle and power module assembly 100, and also includes cable guides 1210 and 1211 at the opposite cover ends which allow for the passage of cables 1203 and 1204 sidewardly therethrough. The cable guides 1210 and 1211 allow the cables to exit the cover 1201 at a variety of angles depending upon the destination of the routing of the cables 1203 and 1204 on the tonneau cover 7. For example, cables 1203 and 1204 are shown in FIG. 40 extending along first paths in a first configuration wherein cable 1203 angles downwardly to a tubular cable channel 1214 formed in the cover end wall 15 while cable 1204 angles upwardly past a flange 1215. The guide channels 1210 and 1211 are sized to also permit the cables to angle in alternate configurations.

Figure 43:
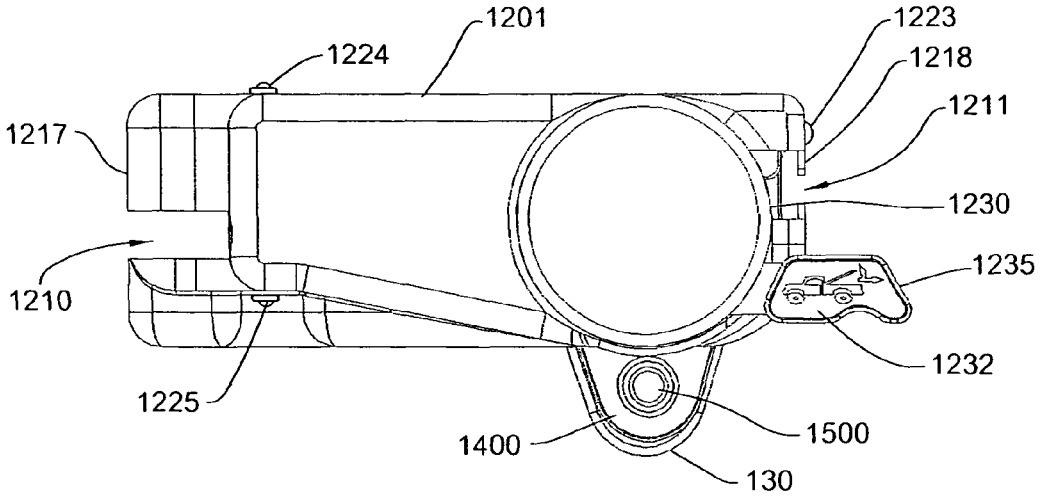
FIG. 43 is a rear view thereof showing a cover mounted in position.
Figure 44:
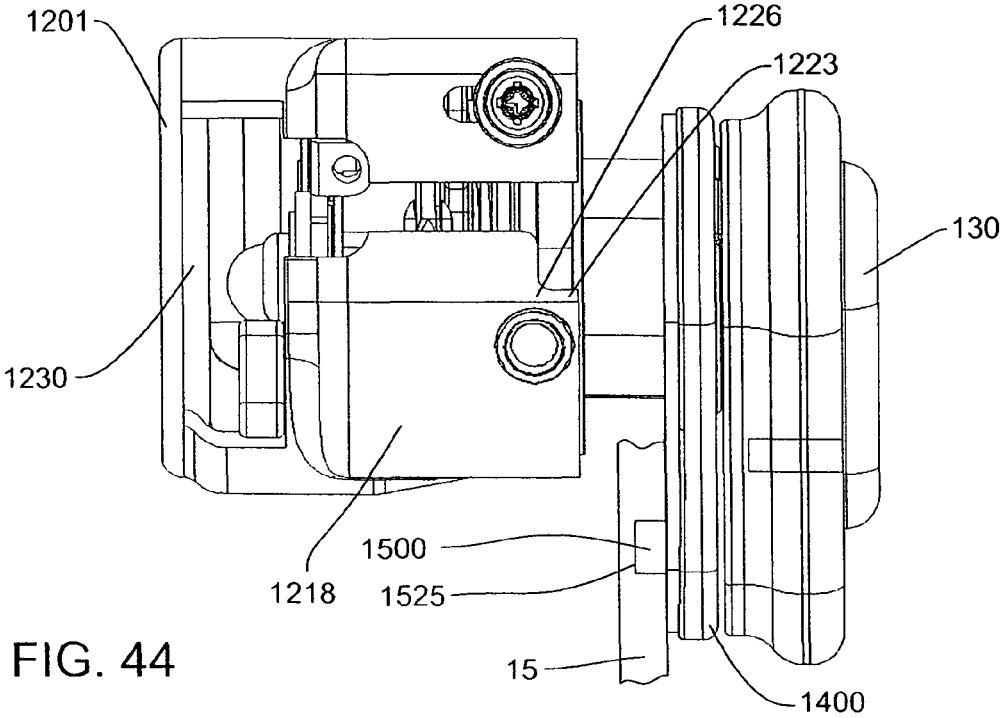
FIG. 44 is a right side view thereof with the cover in a rearwardly displaced position.
Figure 47:
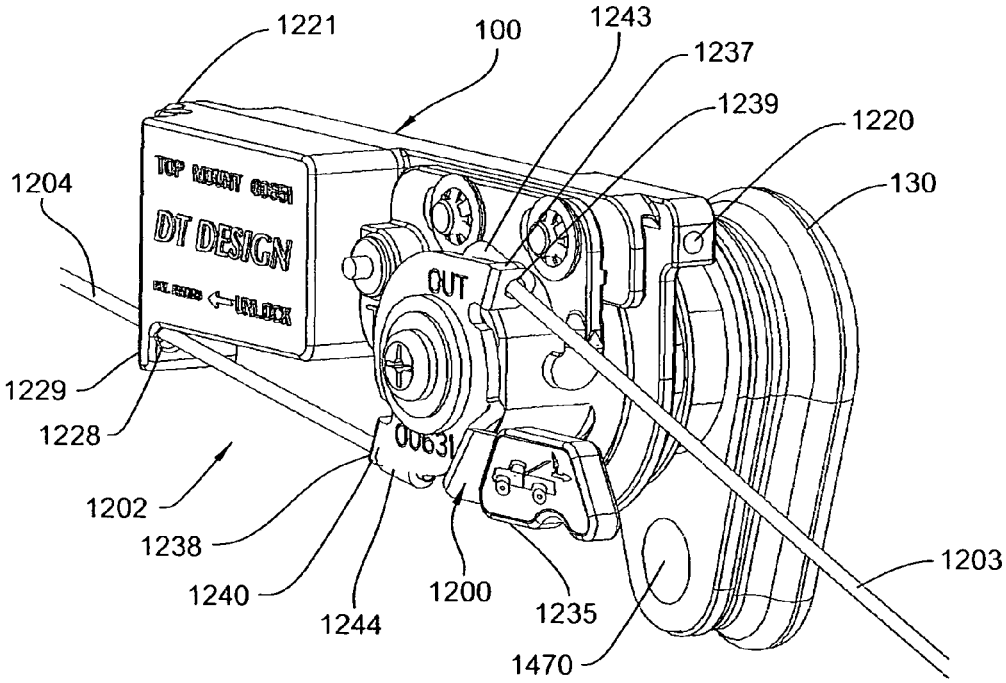
FIG. 47 is a rear perspective view thereof.

For example, the flange 1215 may include a guide bore 1216 through which the cable 1204 would angle farther upwardly in the second configuration designated as 1204-1. In another example, cable 1203 could instead angle upwardly in the second configuration designated as 1203-1. Referring to FIGS. 43 and 44, the guide channels 1210 and 1211 preferably are horizontally elongate and formed in the respective cover end walls 1217 and 1218 which allows the cables 1203 and 1204 to not only vary in their vertical angular orientation shown in FIG. 40 but also may vary in their horizontal angular orientation since the guide channels 1217 and 1218 are horizontally elongate. Further, these guide channels 1217 and 1218 are open on the front side or end disposed proximate the cover end wall 15 (FIG. 44) to allow the cover 1201 to be fitted into position when the cables 1203 and 1204 are already connected to the release handle assembly 1200 as seen in FIG. 47.

Figure 45:
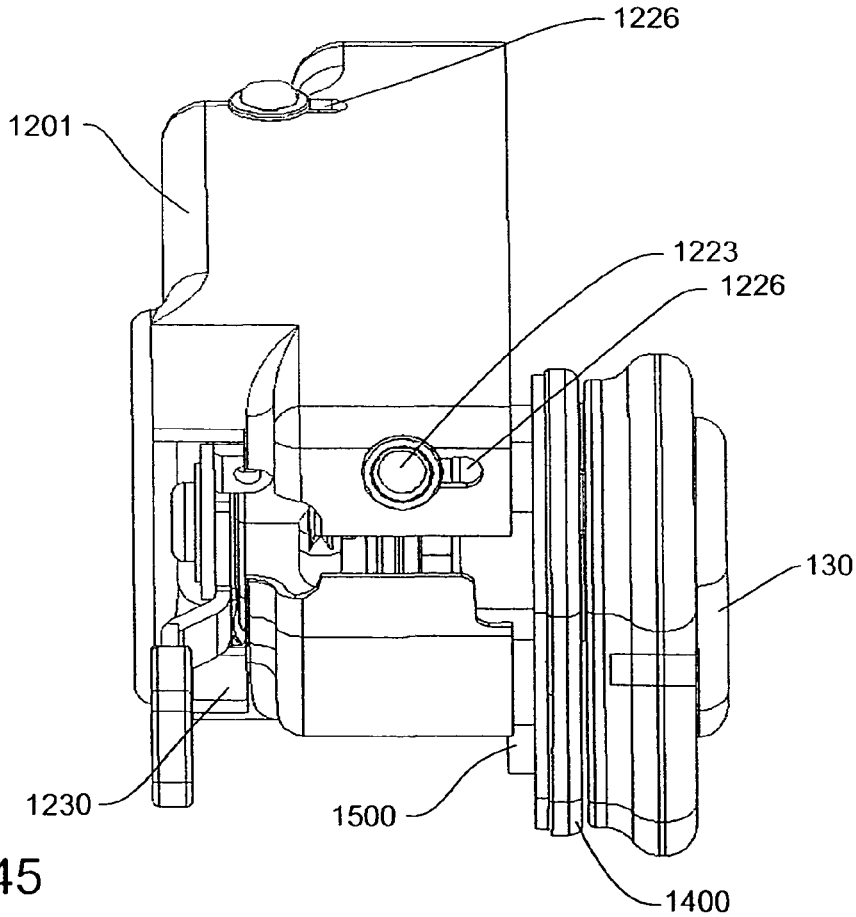
FIG. 45 shows the cover in a forwardly displaced position.

To secure the cover 1201 in position, the power module 120 is provided with cover mounts 1220, 1221 and 1222 (FIGS. 47 and 46) which are formed as open-ended bores and threadedly engage with fasteners 1223, 1224 and 1225 respectively (FIGS. 43 and 44). Each of the fasteners 1223, 1224 and 1225 passes through a fastener slot 1226 (FIG. 45) formed in the cover 1201 which slots 1226 are elongate to permit the cover 1201 to be adjusted from a first outward position seen in FIG. 44, and a second inward position seen in FIG. 45. This allows the cover 1201 to be snugged up tightly against the inside surface of the cover end wall 15 during installation.

The power module 120 also is formed with cable guide 1228 to ensure that the cable 1204 extends to the end of the power module 120 without interference, and as the cable 1204 exits the cable guide 1228, the cable 1204 can bend at a desired angle depending upon the routing of the cable 1204, as previously described relative to FIG. 40. The cable guide 1228 preferably is defined by a downwardly projecting flange 1229 formed by the housing of the power module 120. The flange 1229 is positioned closely proximate the respective guide channel 1210 formed in cover 1201.

Figure 41:
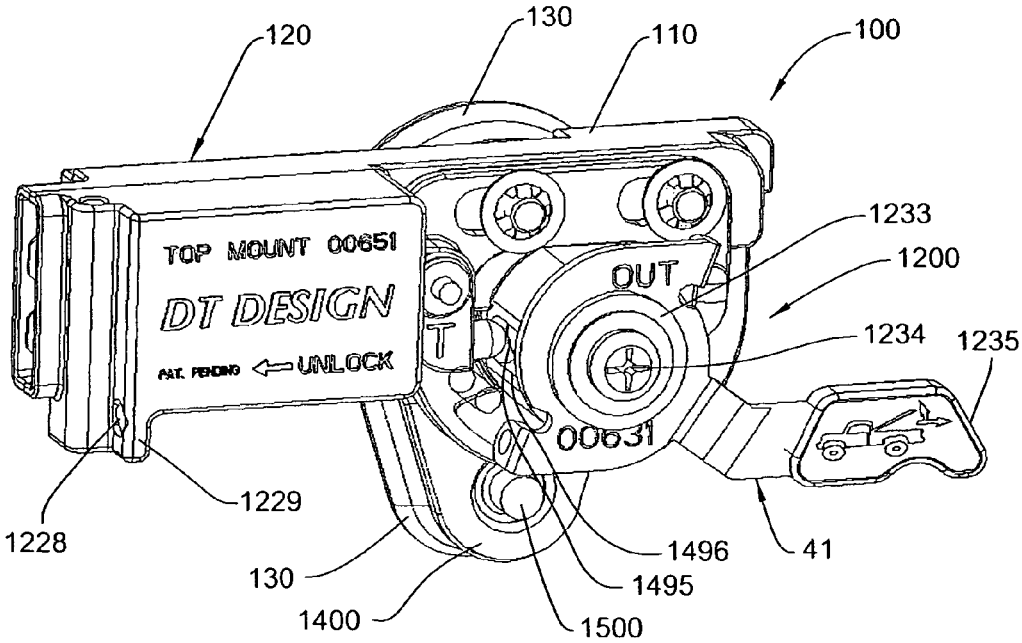
FIG. 41 is a perspective view thereof showing a manual release handle assembly.
Figure 42:
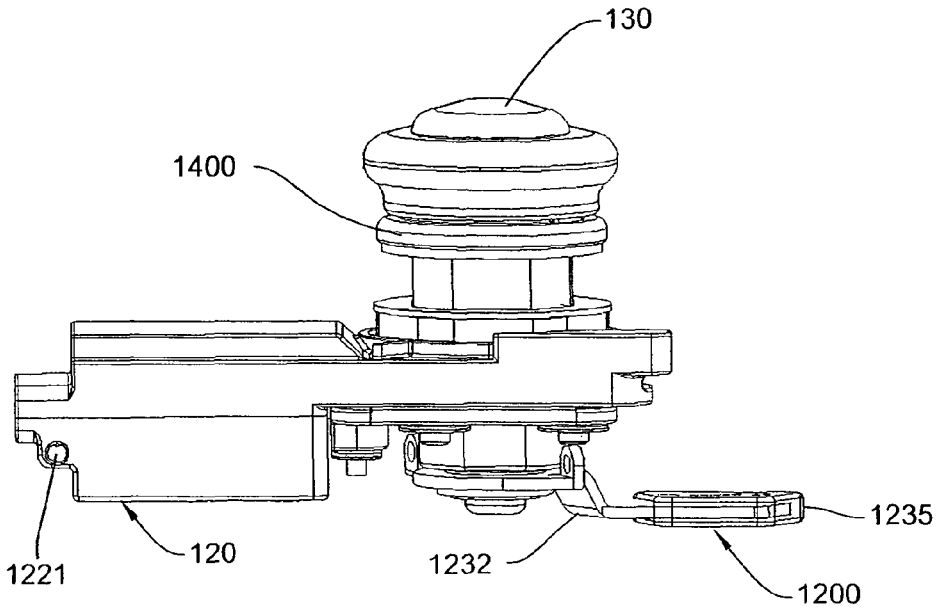
FIG. 42 is a top view thereof.

The cover 1201 also includes a handle slot 1230 which is vertically elongate and allows the release handle assembly 1200 to be operated therethrough. The release handle assembly primarily comprises a release handle 1232 (FIGS. 41 and 48), but also includes a washer 1233 and a fastener 1234 which connect the release handle 1232 to the handle 130. The end of the handle 1232 has an overmolded cover 1235 (FIG. 43) which is formed of a phosphorescent ABS material or other similar photoluminescent material. As such, the cover 1235 is readily visible in the dark, such as in an emergency when a person is trapped in the truck bed. This person can readily see the handle cover 1235 when it glows in the dark, and can see the visible indicia on the cover 1235, see FIG. 43, which provides operational instructions, preferably by a picture which shows the cover being opened and has arrows indicating how to escape. The release handle 1232 is driven in one rotational direction by the handle 130 when the handle is used to operate the latching mechanism 1202, but also is independently movable in the opposite rotational direction so that the release handle 1232 can independently release the latching mechanism 1202 without regard to operation of the handle 130 and without regard to whether the handle assembly 110 is locked or not.

Figure 48:
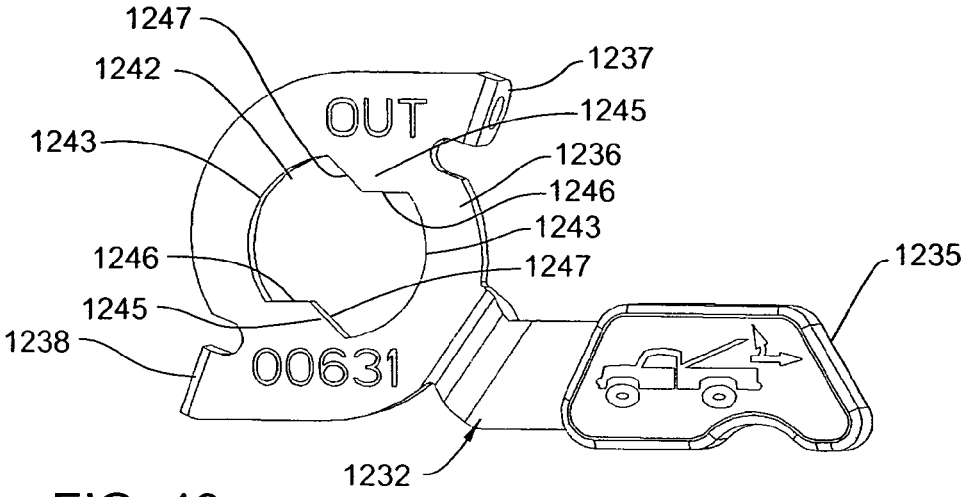
FIG. 48 is a front view of the release handle.
Figure 49:
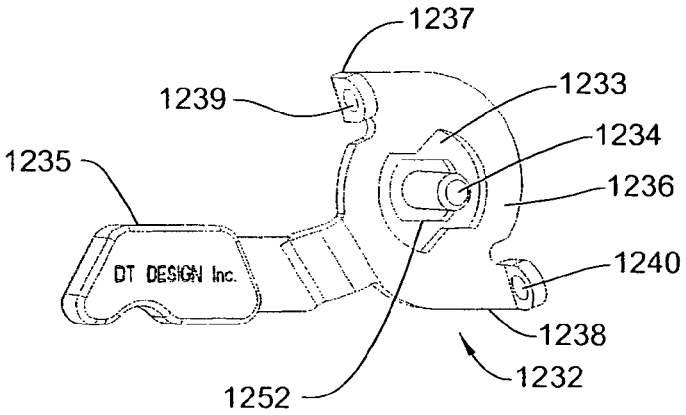
FIG. 49 is a rear perspective view of the release handle.
Figure 50:
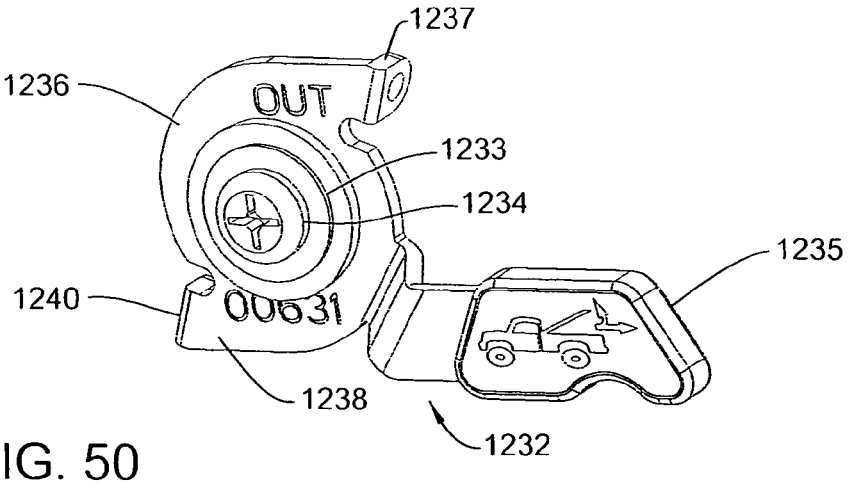
FIG. 50 is a front perspective view of the release handle.

Generally as shown in FIGS. 48-50, the release handle 1232 comprises a drive disk 1236 which is circular about most of the circumference, and which has a pair of cable mounting flanges 1237 and 1238. The mounting flanges 1237 and 1238 extend tangentially from the drive disk 1236 and then bend at right angles to define cable eyelets 1239 and 1240 for engaging cables 1203 and 1204. As seen in FIG. 47, the cables 1203 and 1204 extend through their respective eyelets 1239 and 1240 and have enlarged cable heads 1243 and 1244 which prevent the cables 1203 and 1204 from pulling out of the eyelets 1239 and 1240. Hence, counterclockwise rotation of the handle 1232 (FIG. 47) during rotation of the handle 130 pulls the cables 1203 and 1204 to release the latch mechanism 1202.

To mount the release handle 1232 to the end 280 of the handle shaft 175 as seen in FIGS. 51 and 52, the shaft portion 175 of the handle 130 has the modified construction in that the tip portion 280 is formed with a flat end face 1210 and a mounting hub 1211 projecting therefrom. The handle drive disk 1236 includes a central disk aperture 1242 (FIGS. 48 and 51) which rotatably mounts on the hub 1211. The disk aperture 1242 has non-circular shape although it includes two diametrically opposite, arcuate rotation edges 1243 which define two segments of a circle. The rotation edges 1243 fit closely adjacent the opposite arcuate side edges 1212 of the mounting hub 1211 so that the side edges 1212 and rotation edges 1243 have a common center axis and the release handle 1232 rotates about such axis.

The disk aperture 1242 also includes two radial projections 1245 which project radially inwardly and are each defined by two stop faces 1246 and 1247 which essentially face in opposite clockwise and counterclockwise directions. The clockwise-facing stop faces 1246 are normally disposed in contact with straight hub edges 1213 on the top and bottom of the hub 1211 as seen in FIG. 51. The cables 1203 and 1204 normally pull the release handle 1232 clockwise until the aperture stop faces 1246 abut against the hub edges 1213. As a result, counterclockwise rotation of the handle shaft 175 causes the drive disk 1236 to pull the cables 1203 and 1204 and release the latch mechanism 1200. The cables 1203 and 1204 are normally resiliently biased against such movement by springs or other biasing elements that maintain the cables in tension such that release of handle 130 allows the cables to return to their initial position (FIG. 47) with the stop faces 1246 remaining in contact with the hub edges 1213. As such, the release handle 1232 serves to connect the cables 1203 and 1204 to the handle 130 so that the handle 130 controls actuation of such cables during clockwise rotation thereof (FIG. 47).

However, the release handle 1232 is unrestrained in the counterclockwise direction and is relatively movable counterclockwise without effecting any rotation of handle 130. In particular, the counterclockwise-facing stop faces 1247 of the disk aperture essentially define a clearance space 1250 along half of the straight hub edges 1213 which thereby allows the release handle 1232 to rotate counterclockwise while the hub 1211 and its associated handle 130 remains stationary. In particular, the release handle 1232 is captured on the hub 1211 by the aforementioned washer 1233 and fastener 1234 but the washer 1233 still permits counterclockwise rotation of the release handle 1232 until the point when counterclockwise stop faces 1247 come into contact with the hub edges 1213. While rotation is thus limited, this rotation of the release handle 1232 is sufficient to pull cables 1203 and 1204 to release the latching mechanism 1200, simply by manual rotation of the release handle 1232. Since the cables 1203 and 1204 are in tension and subject to a resilient restoring force, this restoring force will return the release handle 1232 to the initial position of FIGS. 51 and 52 in the absence of any movement of the handle 130. Hence, the handle 130 may be stationary and may even be locked such that rotation of handle 130 is prevented, yet the release handle 1232 still may be manually rotated counterclockwise to release the latching mechanism 1200 such as in an emergency.

The washer 1233 includes center bore 1252 (FIG. 49) which has a non-circular shape corresponding to the shape of hub extension 1214, which namely is provided with two arcuate edges and a pair of straight edges on the top and bottom thereof. This prevents any rotation of washer 1233 relative to hub 1211 during rotation of the release handle 1232, which prevents the washer 1233 from tending to unthread the fastener 1234. The center of the hub extension 1214 includes the fastener bore 1215 which threadedly engages the fastener 1234 for mounting the release handle 1232 on the hub 1211. Hence, the release handle 1232 serves as a drive disk to drivingly interconnect the handle 130 to the cables 1203 and 1204 yet also is unrestrained in a second condition to permit release of such cables independently of the handle 130 and without regard to whether the handle 130 is locked.

While the release handle assembly 1200 could be replaced with direction connection between handle shaft 175 and cables 1203 and 1204 that does not provide any release function, the release handle assembly 1200 is preferred. Further, the release handle assembly 1200 may be used with or without the power module 120.

Although particular preferred embodiments of the invention have been disclosed in detail for illustrative purposes, it will be recognized that variations or modifications of the disclosed apparatus, including the rearrangement of parts, lie within the scope of the present invention.

What is claimed is:

1. A locking assembly for a truck bed closure having a wall, the locking assembly comprising:

a bushing configured to be supported on the wall of the truck bed closure, said bushing including a bushing wall defining a bore therein;

a handle assembly comprising an exterior handle which is manually rotatable, a rotatable shaft rotatably supported in said bore and connected to said handle for rotation therewith, and a key cylinder rotatably mounted within an interior of the shaft, said shaft including a transverse passage and said key cylinder including a slide bolt engagement tab extending from an interior end of the key cylinder;

a slide bolt mounted within said transverse passage in the shaft and slidable between a locked position engaged with said bushing and an unlocked position disengaged from said bushing; and a power module configured for attachment to an interior end of the handle assembly adjacent the wall of the truck bed closure, the power module including a mounting frame and a drive plate movable with respect to the mounting frame between a locking position and an unlocking position, said drive plate including a slide bolt locking projection and a slide bolt unlocking projection which move said slide bolt respectively between said locked and unlocked positions upon movement of said drive plate.

2. The locking assembly of claim 1, wherein rotation of the key cylinder and the slide bolt engagement tab shifts the slide bolt from one of said locked position and said unlocked position to the other of said locked position and said unlocked position.

3. The locking assembly of claim 1, wherein the drive plate is slidably mounted along a substantially linear path on said mounting frame.

4. The locking assembly of claim 1, said power module further comprising a solenoid having an actuation arm which is connected to said drive plate.

5. The locking assembly of claim 4, wherein the key cylinder and the solenoid are each engageable with the slide bolt and operable independently of each other to permit selective movement of said slide bolt.

6. The locking assembly of claim 5, wherein the solenoid has an electrical input electrically connectable to a vehicle electrical system.

7. The locking assembly of claim 5, wherein the drive plate is slidably mounted along a substantially linear path on said mounting frame.

8. The locking assembly of claim 5, wherein the drive plate further comprises a knob configured to enable manual movement of the drive plate between said locking position and said unlocking position.

9. A locking assembly for a truck bed closure having a wall having an aperture therethrough, the locking assembly comprising:

an exterior handle body having a gripping portion and a shaft portion;

a bushing having an external profile configured to fit in said aperture, and an exterior flange configured to engage the wall of the truck bed closure, said bushing having a central passage through which said shaft portion extends, and said external profile having a threaded portion;

an anti-rotation washer having an internal profile configured to non-rotationally engage said external profile of said bushing, and including a plurality of teeth extending from an exterior perimeter thereof and at least one wedging element configured to match a flat portion of said external profile of said bushing;

a bushing nut threadably received on said threaded portion of said external profile and bearing against said anti-rotation washer to drive said anti-rotation washer between said external profile of said bushing and the wall of the truck bed closure within the aperture therethrough;

said external profile of said bushing further including a groove portion at an interior end thereof, and a dust cap being provided over said interior end which removably engages said groove portion; and a power module is mountable to said interior end of the bushing adjacent an inner face of the wall of the truck bed closure when said dust cap is removed, the power module including a mounting fame having an aperture with an internal profile configured to non-rotatably engage said external profile of said bushing, wherein fastener structure is provided which engages said groove portion to support said mounting frame on said bushing.

10. The locking assembly according to claim 9, wherein said fastener structure is a snap ring engaged with said groove portion.

11. The locking assembly according to claim 9, wherein said bushing includes transverse passages which open sidewardly into said central passage, said shaft portion including a key cylinder rotatably mounted within an interior of the shaft portion, and said shaft portion including a slide passage which is alignable with said transverse passages when said shaft portion is in a first rotary position and misaligned when in a second rotary position, a slide bolt being mounted within said slide passage and slidable between a locked position with said slide bolt extended into engagement with a said transverse passage of said bushing and an unlocked position wherein said slide bolt is retracted out of engagement from any of said transverse passages of said bushing.

12. The locking assembly according to claim 11, wherein said power module includes a mounting frame and a drive plate movable with respect to the mounting frame between a locking position and an unlocking position, said drive plate including a slide bolt locking projection and a slide bolt unlocking projection which are alternately insertable into respective ones of said transverse passages to drive said slide bolt in reversible directions.

13. The locking assembly according to claim 12, wherein said drive plate moves said slide bolt respectively between said locked and unlocked positions upon movement of said drive plate.

14. The locking assembly according to claim 12, wherein said unlocking projection is insertable into a respective one of said transverse passages to displace said slide bolt out of said one transverse passage to permit rotation of said shaft portion.

15. A locking assembly comprising:

a bushing including a bushing wall defining a bore therein and transverse passages extending through said bushing wall;

a handle assembly comprising an exterior handle which is manually rotatable, a rotatable shaft rotatably supported in said bore and connected to said handle for rotation therewith, and a key cylinder rotatably mounted within an interior of the shaft so as to be rotatable relative to said shaft to effect locking and locking of said handle assembly, said shaft including a slide passage, and a slide bolt mounted within said slide passage, wherein said slide passage is alignable with said transverse passages when said shaft is in a first rotary position and misaligned when in a second rotary position, and said slide bolt is slidable between a locked position with said slide bolt engaged with a said transverse passage of said bushing when said shaft is in said first rotary position and an unlocked position wherein said slide bolt is disengaged from any of said transverse passages of said bushing to permit rotation of said shaft to said second rotary position, and said key cylinder engaging said slide bolt to effect sliding movement thereof in response to rotation of said key cylinder to one of said locked or unlocked positions; and a power module configured for attachment to an interior end of the handle assembly, the power module including a mounting frame supported on said bushing and a drive plate movable with respect to the mounting frame between a locking position and an unlocking position, said drive plate including a slide bolt locking projection and a slide bolt unlocking projection which are alternately insertable into respective ones of said transverse passages when in said respective locking and unlocking positions to drive said slide bolt in reversible directions and move said slide bolt respectively between said locked and unlocked positions upon movement of said drive plate.

16. The locking assembly of claim 15, wherein the key cylinder and the drive plate are each operably connected to the slide bolt and operable independently of each other to permit selective movement of said slide bolt by manual rotation of said key cylinder or automatically by said power module.

17. The locking assembly of claim 16, wherein the power module has an electrical input electrically connectable to a vehicle electrical system to operate said power module remote from said locking assembly.

18. The locking assembly according to claim 17, wherein said unlocking projection is insertable into a respective one of said transverse passages to displace said slide bolt out of said one transverse passage to permit rotation of said shaft.

19. A locking assembly for a truck bed closure having a wall, the locking assembly comprising:

a bushing configured to be non-rotatably supported on the wall of the truck bed closure, said bushing including a bushing wall defining a bore therein and transverse passages extending through said bushing wall;

a handle assembly comprising an exterior handle which is manually rotatable, a rotatable shaft rotatably supported in said bore and connected to said handle for rotation therewith, said shaft being operably connected to a latch mechanism wherein rotation of said shaft effects a release of said latch mechanism, said shaft including a slide passage, and said latch mechanism including a slide bolt mounted within said slide passage, wherein said slide passage is alignable with said transverse passages when said shaft is in a first rotary position and misaligned when in a second rotary position, and said slide bolt is slidable between a locked position with said slide bolt engaged with a said transverse passage of said bushing when said shaft is in said first rotary position and an unlocked position wherein said slide bolt is disengaged from any of said transverse passages of said bushing to permit rotation of said shaft to said second rotary position;

a manual lock mechanism mounted in said handle assembly which engages said slide bolt to effect sliding movement thereof to one of said locked or unlocked positions in response to manual actuation of said lock mechanism;

a manual release mechanism which is supported on said shaft and effects release of said latch mechanism in the absence of movement of said shaft and without regard to said slide bolt being in said locked position or said unlocked position, said release mechanism being accessible from an interior of the truck bed closure; and a power module configured for attachment to an interior end of the handle assembly the power module including a mounting frame supported on said bushing and a drive plate movable with respect to the mounting frame between a locking position and an unlocking position, said drive plate including a slide bolt locking projection and a slide bolt unlocking projection which are alternately insertable into respective ones of said transverse passages when in said respective locking and unlocking positions to drive said slide bolt in reversible directions and move said slide bolt respectively between said locked and unlocked positions upon movement of said drive plate; the manual look mechanism and the drive plate each being operably connected to the slide bolt and operable independently of each other to permit selective movement of said slide bolt by manual actuation of said lock mechanism or automatically by said power module.

20. The locking assembly according to claim 19, wherein said bushing has a radial extension arm with a stop projection projecting toward an exterior surface of the truck bed closure for seating within a cavity of the wall of the truck bed closure which prevents rotation of said bushing relative to the truck bed closure; said bushing further having an external profile and said extension arm configured to engage an external face of the wall of the truck bed closure, and said external profile having a threaded portion; and a bushing nut threadedly received on said threaded portion of said external profile and bearing against an inside surface of the wall of the truck bed closure to draw said projection into said cavity and secure said bushing to the wall of the truck bed closure.

21. The locking assembly according to claim 20, wherein said extension arm and said handle project radially from said shaft so that said handle overlies said extension arm but is rotatable away from said extension arm.

22. The locking assembly according to claim 19, wherein said release mechanism having a manually movable handle which is photo luminescent so as to be visible from said interior of the truck bed closure.

* * * * *